US011015349B2

(12) United States Patent
Byszenski et al.

(10) Patent No.: US 11,015,349 B2
(45) Date of Patent: May 25, 2021

(54) APPARATUS FOR COVERING AND UNCOVERING A SURFACE USING COUPLED SELF-PROPELLED ADJUSTABLE SLATS

(71) Applicant: BIOSSUN, Sassenage (FR)

(72) Inventors: Alexandre Byszenski, Montluel (FR); Frédéric Foretti, Velleron (FR)

(73) Assignee: BIOSSUN, Sassenage (FR)

( * ) Notice: Subject to any disclaimer, the term of this patent is extended or adjusted under 35 U.S.C. 154(b) by 322 days.

(21) Appl. No.: 16/092,236

(22) PCT Filed: Apr. 12, 2017

(86) PCT No.: PCT/FR2017/050877
§ 371 (c)(1),
(2) Date: Oct. 9, 2018

(87) PCT Pub. No.: WO2017/178757
PCT Pub. Date: Oct. 19, 2017

(65) Prior Publication Data

US 2019/0145107 A1 May 16, 2019

(30) Foreign Application Priority Data

Apr. 12, 2016 (FR) ..... 16 53199

(51) Int. Cl.
*E04F 10/10* (2006.01)
*E06B 7/092* (2006.01)
(Continued)

(52) U.S. Cl.
CPC ..... *E04F 10/10* (2013.01); *E04B 7/163* (2013.01); *E04B 7/166* (2013.01); *E06B 7/092* (2013.01); *E06B 7/096* (2013.01)

(58) Field of Classification Search
CPC ..... E04F 10/10; E04F 10/08; E04B 7/163; E04B 7/166; E06B 7/084; E06B 7/08;
(Continued)

(56) References Cited

U.S. PATENT DOCUMENTS 2,179,882 A * 11/1939 Durre ..... E06B 9/302 160/169
2,556,352 A * 6/1951 Wellensiek ..... E06B 9/302 160/169
(Continued)

FOREIGN PATENT DOCUMENTS

AU 7190396 5/1997
AU 694 383 7/1998
(Continued)

*Primary Examiner* — Johnnie A. Shablack
(74) *Attorney, Agent, or Firm* — Clark & Brody LP

(57) ABSTRACT

An installation for covering and uncovering a surface includes a series of slats of adjustable inclination supported by pivot pins via a set having a first carriage and a second carriage. A movement system has, for each head slat, movement motors on board the first and second carriages. For the even-numbered slats, firstly a retractable coupling (A) is fastened between the first carriage of said slat and the first carriage belonging to the head slat or to the neighboring slat of lower number, and secondly a drive system (S) is provided for driving the second carriage of said slat in translation. For each odd-numbered slat that is present, a retractable coupling (A) is fastened between the second carriage of said slat and the second carriage belonging to the neighboring slat of lower number, and a drive system (S) is provided for driving the first carriage of said slat in translation.

20 Claims, 10 Drawing Sheets

(51) Int. Cl.
*E06B 7/096* (2006.01)
*E04B 7/16* (2006.01)

(58) Field of Classification Search
CPC . E06B 7/082; E06B 7/086; E06B 9/06; E06B 9/0661; E06B 9/0676
See application file for complete search history.

(56) References Cited

U.S. PATENT DOCUMENTS 2,642,018 A * 6/1953 Weeber ..... A01G 9/241 52/277
3,284,951 A * 11/1966 Shapiro ..... E06B 7/084 49/74.1
3,744,544 A * 7/1973 Wellensiek ..... E06B 9/302 160/169
3,763,606 A * 10/1973 Rindebong ..... E04D 3/32 52/64
4,128,307 A * 12/1978 Badertscher ..... E04F 10/10 359/596
4,449,563 A * 5/1984 Toda ..... E06B 9/26 160/184
4,527,355 A * 7/1985 Numakami ..... E04F 10/10 49/275
4,571,897 A * 2/1986 Kerr ..... E04D 3/28 52/13
5,289,863 A * 3/1994 Schon ..... E06B 9/364 160/168.1 R
5,732,507 A * 3/1998 Edwards ..... E04B 7/163 49/74.1
5,873,202 A * 2/1999 Parks ..... E04B 7/163 49/74.1
6,202,363 B1 * 3/2001 Chang ..... E04B 7/163 160/22
6,240,998 B1 * 6/2001 Miwa ..... E06B 9/364 160/168.1 V
6,405,782 B1 * 6/2002 Cheng ..... E06B 9/368 160/168.1 P
6,866,078 B1 * 3/2005 Lin ..... E06B 9/362 160/177 V
7,370,684 B2 * 5/2008 Padan ..... E06B 3/927 160/169
8,201,609 B1 * 6/2012 Kitterman ..... E06B 9/0676 160/201
8,528,621 B2 * 9/2013 Murphy, Jr. ..... E04F 10/10 160/5
8,756,873 B1 * 6/2014 Hire ..... E04F 10/10 52/72
9,145,732 B2 * 9/2015 Frigerio ..... E04B 7/163
9,222,264 B1 * 12/2015 Reid ..... E06B 9/302
9,410,365 B2 * 8/2016 Hashemi ..... E06B 9/302
9,605,475 B2 * 3/2017 De Muelenaere ..... E06B 9/302
9,732,553 B2 * 8/2017 Rotchell ..... E06B 7/096
10,094,121 B2 * 10/2018 Van Luchene ..... E06B 9/0638
10,094,122 B1 * 10/2018 Akbulut ..... E04F 10/10
10,280,625 B2 * 5/2019 Byszenski ..... E04F 10/10
2003/0056326 A1 * 3/2003 Ko ..... E06B 9/362 16/336
2008/0121351 A1 * 5/2008 Lin ..... E06B 9/36 160/177 V
2008/0210388 A1 * 9/2008 Padan ..... E06B 9/302 160/201
2009/0071612 A1 * 3/2009 Hung ..... E06B 9/364 160/174 V
2009/0158673 A1 * 6/2009 Friedman ..... E04B 7/163 52/66
2011/0041407 A1 * 2/2011 van de Bult ..... E06B 7/086 49/79.1
2013/0056159 A1 * 3/2013 Gray ..... E04F 10/10 160/40
2013/0118082 A1 * 5/2013 Colson ..... E06B 7/096 49/82.1
2013/0212946 A1 * 8/2013 Villarreal, Jr. ..... E06B 7/096 49/90.1
2013/0248124 A1 * 9/2013 Barbulescu ..... E04F 10/10 160/59
2014/0175240 A1 * 6/2014 Selzer ..... E04F 10/10 248/237
2015/0159430 A1 * 6/2015 Huang ..... E06B 9/368 160/168.1 P
2015/0368959 A1 * 12/2015 Holford ..... E06B 7/096 49/82.1
2015/0376901 A1 * 12/2015 Partridge ..... E04F 10/10 52/1
2016/0032642 A1 * 2/2016 Rotchell ..... E06B 7/086 49/82.1
2016/0177575 A1 * 6/2016 Ivic ..... E04F 10/10 52/302.1
2017/0138057 A1 * 5/2017 Ventrella ..... E04F 10/10
2017/0226746 A1 * 8/2017 Byszenski ..... E04B 7/166
2018/0106046 A1 * 4/2018 Castel ..... E04F 10/0648
2019/0145107 A1 * 5/2019 Byszenski ..... E06B 7/092 160/62

FOREIGN PATENT DOCUMENTS

| | | |
|---|---|---|
| EP | 1 595 053 | 11/2005 |
| EP | 2 868 833 | 6/2015 |
| FR | 1 475 733 | 4/1967 |
| JP | 2006-022500 | 1/2006 |
| WO | 2012/107350 | 8/2012 |

* cited by examiner

APPARATUS FOR COVERING AND UNCOVERING A SURFACE USING COUPLED SELF-PROPELLED ADJUSTABLE SLATS

The present invention relates to the technical field of installations for covering and uncovering a surface by using slats of adjustable inclination extending parallel to one another so as to constitute a screen for protecting or closing a surface in the general sense, the adjustable slats, when in the deployed position relative to the surface, being capable of inclining to open or to close the surface as a function of weather conditions, in particular.

The subject matter of the invention covers numerous applications in particular for constituting a covering for a roof forming a portion of a pergola or a terrace, for example, or a protective screen for a door or a window.

In the state of the art, e.g. from Document AU 7 190 396, it is known to make a roof from a succession of adjustable slats having their longitudinal edges extending parallel to one another. At each of their ends, the adjustable slats are provided with respective pivot pins that are supported by a carrier structure. The adjustable slats are controlled to pivot together by means of a motor system so as to occupy either a closed position in which the slats touch one another via their longitudinal edges, or else an open position in which the slats do not touch one another so as to allow air and light rays from the sun to pass through.

Compared with stationary roofing that serves only to protect a space from rain and sun, that openable roof also makes it possible to control, at will, the ventilation and the sunshine in the space fitted with such a roof. Nevertheless, that openable roof presents the drawback of leaving the adjustable slats permanently over the surface that is to be covered, which can constitute a drawback, in particular during a long period of no sunshine.

To remedy that problem, in the field of closure shutters, an installation is known from patent FR 1 475 733 for covering and uncovering an opening by means of adjustable slats extending parallel to one another, with each of them having a pivot pin at each of its ends. On either side of the adjustment ends of the slats, the installation has a mechanism adapted to adjust the inclination of the slats about their pivot axes, and to move the slats between a deployed position and a position stowed in a magazine in which the slats are placed one beside another.

Each adjustment-and-movement mechanism comprises firstly an outer endless chain or belt mounted between stationary return pulleys and presenting an outer stand and an inner stand, and secondly an inner endless belt mounted between stationary return pulleys and presenting an outer strand and an inner strand that extend in register with the inner strand of the outer belt so as to define between them a drive passage for the slats. Each adjustment-and-movement mechanism has a synchronized motor system for the outer belt and a synchronized motor belt for the inner belt. The motors of the motor systems are controlled firstly to move the inner strands in the same direction so as to move the slats in translation in the drive passage, and secondly to move the inner strands in opposite directions so as to adjust the inclination of the slats.

Each adjustment-and-movement mechanism includes a slat distribution device driven by the synchronized motor systems for the belts and adjusted, in one movement direction of the strands, to engage the slats in succession and at a constant spacing pitch in the drive passage, and in opposite movement direction, to disengage the slats in succession from the drive passage so that they occupy their stowed position.

That installation is not designed to constitute a roof, and in practice it is found to be unsuitable for covering an opening that is relatively large. Another drawback of such an installation lies in the need to provide a storage magazine for the slats. The storage magazine is arranged either to occupy part of the surface that is to be covered or else is arranged beside that surface to be covered, if space is available for that purpose.

Patent EP 1 595 053 describes a mechanism for closing an opening by using slats, each provided at each of its ends with a nut that co-operates with a motor-driven screw extending over the entire length of the opening. The nuts are engaged in a guide rail enabling the slats to be moved in translation when the screws are rotated. In a magazine for stowing the slats in a folded position, that mechanism also includes a rack that co-operates with the nuts in order to distribute the slats at a constant pitch or in order to stack them in the magazine. Furthermore, each slat end is provided with a wheel co-operating with a system for adjusting the inclination of the slats.

A drawback of that solution is the presence of a storage magazine in which it is not possible to adjust the inclination of the slats. Furthermore, that solution is complex and expensive to implement because it makes use of screws that are long and because of the accuracy that is needed, in particular in order to change guidance between the slideway and the rack. That solution is found to be unusable in practice for closing an opening that is large.

Patent application WO 2012/107350 describes a thermal shutter system for a window comprising a series of flaps of adjustable inclination extending parallel to one another, each being supported by a guide at each of its ends. The installation includes threaded rods on either side of the flaps and co-operating with a gearbox fitted to each flap guide. The guides for each of the flaps are provided with motors for adjusting the inclination of the flaps and for moving the flaps independently relative to one another.

That installation is found to be complex and expensive to implement because of the use of threaded rods and because of the degree of accuracy that is required for assembly. Such an installation is found to be unsuitable for covering a surface of large dimensions.

Patent EP 2 868 833 describes an installation of adjustable and retractable slats including carriages at each of their ends, the carriages being connected to one another by deformable structures. That train of carriages has a master carriage connected via an endless transmission mechanism to a movement motor arranged on one transverse side of the installation. The slats are adjusted using an adjustment motor placed on one transverse side of the installation and acting on the slats via a linkage. Such an installation is relatively complex to implement and is relatively bulky for housing the means for driving the slats to slide and to pivot.

Patent application US 2013/248124 describes a system for controlling the position and the adjustment relative to the sun of a panel fitted to a window. In a variant embodiment, the panel is moved in translation by means of an electric motor mounted on the panel and having its outlet gearwheel co-operating with a rack carried by the frame of the window. Such a system is not suitable for covering a surface with slats that need to be moved in translation and adjusted in inclination.

The present invention seeks to remedy the drawbacks of the prior art by proposing an installation that is of simple design, that is compact, and that is inexpensive, for using slats of adjustable inclination for covering and uncovering a surface that may equally well be vertical or horizontal and that presents a variety of dimensions in a wide range that may extend to large dimensions.

The present invention seeks to propose an installation that is entirely modular and that can easily be adjusted to the dimensions of the surface to be covered, while providing the advantage of being able to adjust at will the slats in various zones of the surface to occupy different inclinations.

Another object of the invention is to propose an installation that does not require space to be dedicated to stowing the slats in the folded position.

In order to achieve such an object, the installation for using slats of adjustable inclination to cover and uncover a surface defined by a carrier structure comprises:

a series of adjustable slats comprising odd-numbered slats including at least one "head" slat and even-numbered slats interposed between the odd-numbered slats, the adjustable slats extending parallel to one another via their longitudinal edges and each being fitted at its end edges with respective pivot pins;

each slat is supported via its pivot pins by a set comprising a first carriage and a second carriage, each guided to move in translation along a respective guide track;

two guide tracks for guiding movement of the carriages in translation, the tracks being provided on the carrier structure and being arranged in parallel with each other along two opposite sides of the surface;

an adjustment system for adjusting the inclination of the slats and adapted to cause at least some of the slats to pivot so that the longitudinal edges of the slats touch or do not touch respectively so as to close or to open the corresponding surface;

a movement system for moving the slats between a stowed position in which the slats touch one another and a deployed position in which at least some of the slats, including at least one head slat, are deployed in register with the surface;

position and movement sensors for detecting the positions and the movements of the slats; and a control device connected to the sensors, to the movement system, and to the adjustment system, in order to move at least some of the slats in translation and to adjust the inclination of said slats that have been moved in translation.

According to the invention, the movement system comprises: for each head slat, movement motors on board the first and second carriages; for the even-numbered slats, firstly a retractable coupling fastened between the first carriage of said slat and the first carriage belonging to the head slat or to the neighboring slat of lower number, and secondly a drive system for driving the second carriage of said slat in translation; and for each odd-numbered slat that is present, a retractable coupling fastened between the second carriage of said slat and the second carriage belonging to the neighboring slat of lower number, and a drive system for driving the first carriage of said slat in translation; the movement motors on board the carriages being connected to transformation mechanisms for transforming rotary motion into movement of the slats in translation along a direction parallel to the guide track.

Furthermore, the installation of the invention may also present in combination at least one and or another of the following additional characteristics:

the drive system for driving a carriage in translation comprises either a movement motor on board said carriage or else a retractable coupling fastened respectively between the first and second carriages of said slat and the neighboring slat of lower number;

the movement system comprises a single head slat and even and odd numbered slats forming successive slat pairs, each having a slat in common, the slats being connected together by retractable couplings mounted in alternation between the first carriages and the second carriages of the successive slat pairs;

the movement system comprises a plurality of head slats, each driving at least one slat in order to form a slat group, the slat groups not being connected to one another;

each retractable coupling between the first carriages or the second carriages of a slat having a number and a slat having a lower number comprises firstly a locking mechanism for locking the coupling in a towing position when the slat of lower number has been moved through a determined deployment pitch, and secondly an unlocking mechanism for unlocking the locking mechanism in order to place the coupling in a retracted position and acting as soon as the slat of given number occupies its stowed position;

each retractable coupling between the first carriages or the second carriages of a slat of given number and a slat of lower number comprises firstly a keeper system for keeping the slat of given number in position so long as the slat of lower number has not been moved through its determined deployment stroke, and secondly an unlocking system for unlocking the keeper system as soon as the slat of lower number has been moved through its deployment stroke;

each retractable coupling between the carriages of a slat of given number and a slat of a lower number comprises as its mechanism for locking the coupling in a towing position a towbar carried by the carriage of the slat of lower number and arranged to present firstly a traction surface that is to co-operate with a first abutment carried by the carriage of the slat of given number only when the slat of lower number has been moved through its determined deployment stroke and during the operation of deploying said slats, and secondly a thrust surface for co-operating with a second abutment carried by the carriage of the slat of given number, so long as said slat of given number has not reached its stowed position during the operation of stowing said slats, the towbar co-operating, when the slat of given number has reached its stowed position, with the unlocking mechanism between the thrust surface and the second abutment so that the slat of lower number can move until it reaches its stowed position;

each retractable coupling includes as its system for keeping a slat in position a spring rod carried by said slat and cooperating with a catch placed upstream from said slat, the spring rod presenting a shape that is suitable for being released from the catch under the action of a traction force exerted by the slat of lower number;

each retractable coupling between the carriages of a slat of given number and a slat of a lower number comprises two hinged links for co-operating with the locking mechanism of the coupling to form a said first linkage that is incompressible in the towing position, the two links forming a flexible linkage under the action of the unlocking mechanism for unlocking the locking mechanism in order to place the coupling in a retracted position;

each movement motor drives a respective gearwheel in rotation that co-operates with a rack mounted on the carrier structure in a direction parallel to the guide track;

for each pair of carriages fitted to a slat, the adjustment system comprises at least one adjustment motor on board at least one of said carriages and angularly connected with the pivot pin;

for each slat, the movement motor and the adjustment motor are mounted on the same carriage, the carriages fitted with these motors being mounted in alternation from one slat to the next, along each side of the surface for covering or uncovering;

each carriage fitted with a movement motor and with an adjustment motor comprises a main support body for the movement motor and for the adjustment motor, the main body being provided with a guide system for guiding rotation of a tubular shaft fitted with a gearwheel and driven in rotation by the movement motor, the pivot pin being mounted inside the tubular shaft being turned by the adjustment motor and being constrained to turn with the slat;

the position and movement sensors of the slats comprise contact sensors mounted on the carriages of a guide track in order to be actuated by the carriage that is situated upstream in the slat exit direction or by the carrier structure for the carriage of the last slat in the exit direction;

the position and movement sensors of the slats comprise sensors for measuring rotation of the movement motors and rotation of the adjustment motors, together with sensors for detecting the direction of inclination of the slats;

the control device has a plurality of pre-stored modes of operation including a calibration mode and a plurality of utilization modes, each corresponding to a respective type of positioning of the slats;

the control device controls the operation of the movement motors and of the adjustment motors in such a manner that prior to causing a slat to move, the control device causes the adjustment motor of said slat to place it in a vertical position if it is not already in the vertical position;

for a mode of utilization consisting in causing a determined number of slats to exit from their stowed position, the control device causes the movement motors of the slats that are to be deployed to operate so that each time a first slat advances through one pitch, the slat situated upstream is caused to move, the movement motors of the slats being operated until the slats occupy their exited positions;

the control device controls the movement motors in such a manner that the movement pitch of the slats corresponds to the spacing between two consecutive slats that are touching in the screen position; and the control device controls the operation of the adjustment motors only if the slat is occupying a stationary position other than its stowed position.

Various other characteristics appear from the following description given with reference to the accompanying drawings and which show embodiments of the subject matter of the invention as non-limiting examples.

Figure 1:
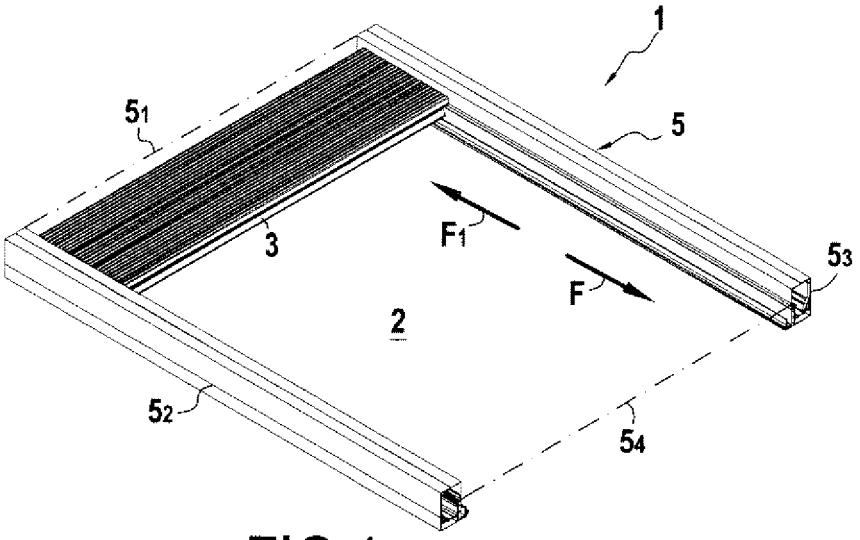
FIG. 1 is a perspective view of an embodiment of an installation in accordance with the invention in which the slats are all arranged in an erect position.

As can be seen more clearly in FIGS. 1 to 4, the subject matter of the invention relates to an installation 1 for covering and uncovering a surface 2 with a series of slats 3 of adjustable inclination extending one behind another and preferably all identical to one another with their longitudinal axes parallel. Each adjustable slat 3 is generally rectangular in shape being defined by first and second mutually parallel longitudinal edges $\mathbf{3}_a$ and $\mathbf{3}_b$, which are connected together by first and second end edges $\mathbf{3}_c$ and $\mathbf{3}_d$ that are likewise mutually parallel. Naturally, the number and the dimensions of the adjustable slats are matched to the dimensions of the rectangular surface 2 for covering.

Preferably, and as can be seen in the drawings, the adjustable slats 3 are suitable together for forming a screen of rectangular shape defined firstly by the longitudinal edge $\mathbf{3}_a$ of the first slat 3 and by the longitudinal edge $\mathbf{3}_b$ of the last slat 3, and secondly by all of first end edges $\mathbf{3}_c$ of the slats in alignment, and by all of second end edges $\mathbf{3}_d$ of the slats in alignment.

At each of their end edges, the slats 3 are provided with respective pivot pins 4 enabling their inclination to be adjusted. The installation 1 has an adjustment mechanism I for adjusting the slats 3 about their pivot pins 4 so as to pivot at least some, and in general manner all, of the slats 3 so that the longitudinal edges $\mathbf{3}_a$ and $\mathbf{3}_b$ of adjacent slats are touching in order to close the corresponding surface, or else are not touching so as to open the surface 2.

Figure 2:
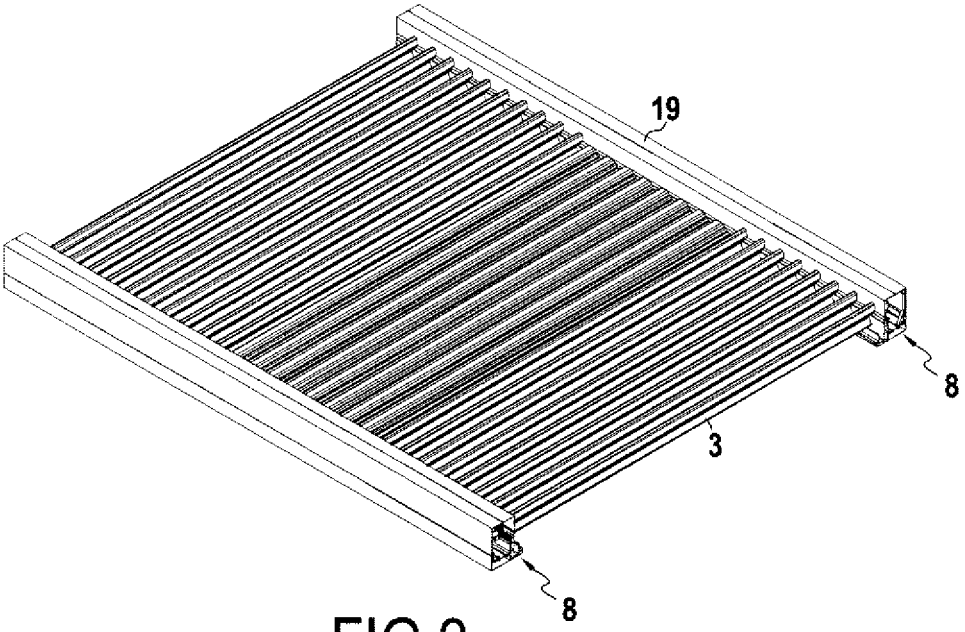
FIG. 2 is a perspective view of an embodiment of an installation in accordance with the invention in which the slats are all deployed, with some of them in a touching position.
Figure 3:
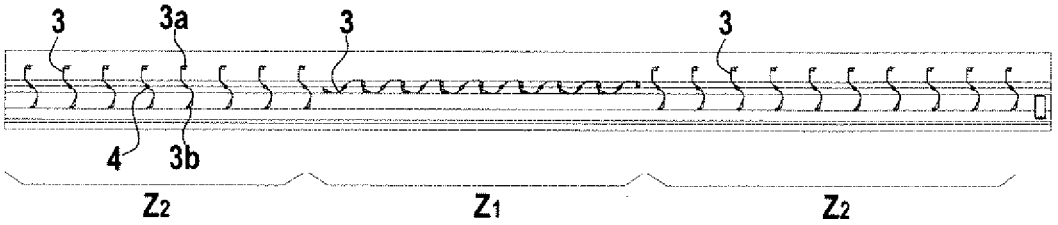
FIG. 3 is a section view of the installation shown in FIG. 2 and showing the pivot positions of the slats in the deployed position.

As can be seen in FIGS. 2 and 3, the adjustable slats 3 may thus form a screen in a zone $Z_1$, providing the longitudinal edges of the slats are touching the longitudinal edges of adjacent slats. In two adjacent zones $Z_2$, the slats 3 are deployed over the surface while occupying an erect or open position. Naturally, this example of deployment of the slats 3 is given solely by way of illustration, insofar as the slats 3 can be deployed and adjusted in numerous other configurations, as can be better understood from the description below.

The installation of the invention also has a movement system II for moving the slats 3 between a stowed position (FIG. 1) and a position in which they are partially or completely deployed in register with the surface 2 (FIGS. 2 and 3). In the stowed position, the slats 3 touch one another between a stowed head slat and a stowage edge $\mathbf{5}_1$ of a carrier structure or sash 5. In this stowed position, the slats 3 cannot be adjusted in inclination and the slats 3 occupy an erect position, i.e. the slats occupy parallel planes that are substantially perpendicular to the surface 2, i.e. vertical in the example shown.

The systems I and II serve to move and to adjust the slats 3 in such a manner that together they form at least one protective screen that can be opened and closed at will. Depending on the intended applications, the screen may form a roof or a protective shutter capable of covering the surface 2 completely, or of covering only a portion of the surface 2, with it being possible for the inclination of the slats to be adjusted at request when the slats are not in the stowed position.

Figure 4:
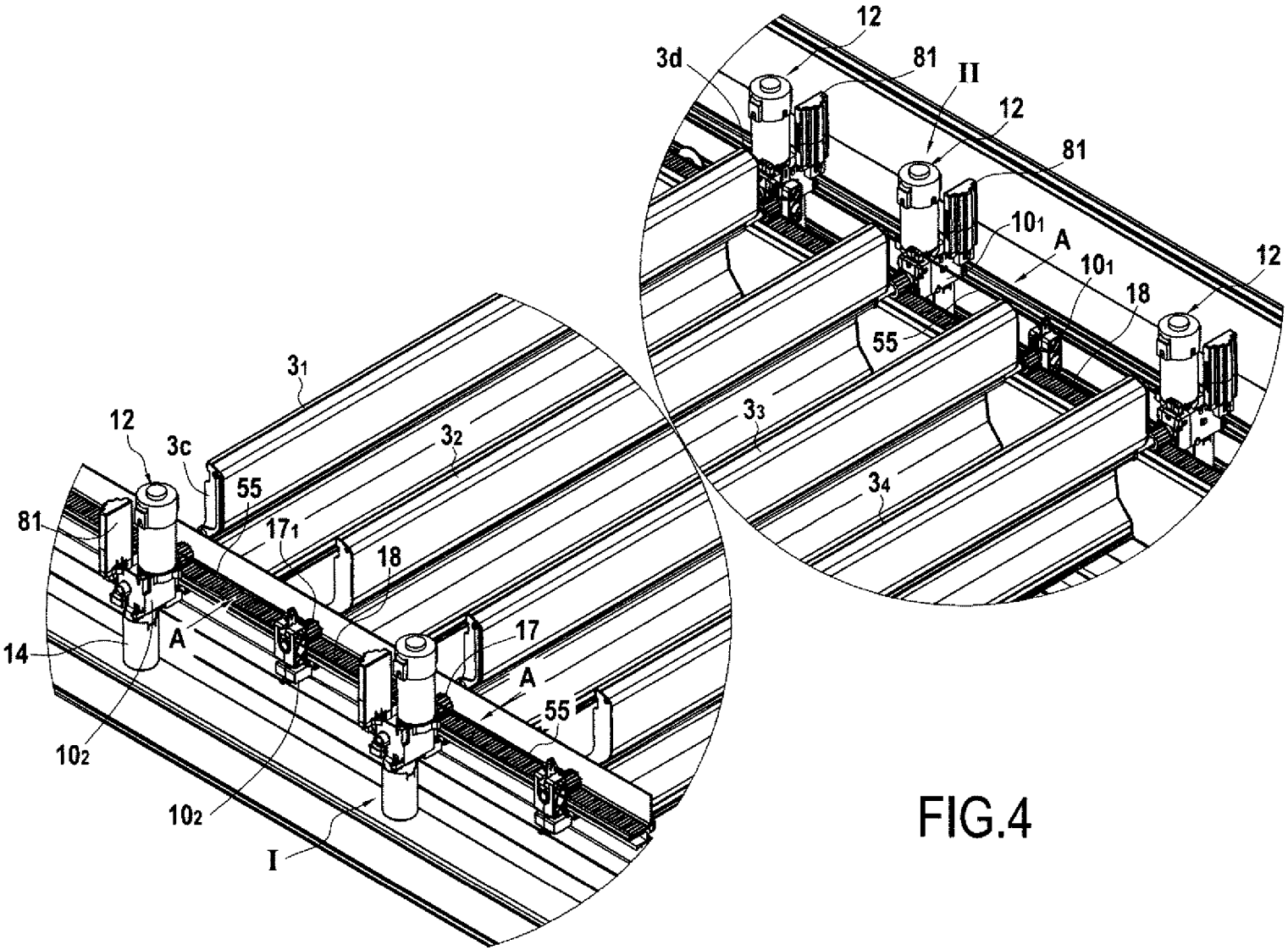
FIG. 4 is a perspective view showing more clearly how the slats forming part of an installation of the invention are moved.

The installation 1 also has two guide tracks 8 serving to guide movement in translation of the slats 3 between a stowed position in which the slats touch one another (FIG. 1) and a deployed position in which at least some or all of the slats 3 are deployed in register with the surface 2 (FIGS. 2 to 4).

The guide tracks 8 are arranged on the carrier structure of the sash 5, which may be made in any suitable manner depending on the intended applications and surrounding the surface 2 that is to be covered in order advantageously to form a frame.

The carrier structure 5 advantageously has two longitudinal bars $\mathbf{5}_2$ and $\mathbf{5}_3$ extending parallel to each other along two opposite longitudinal sides of the surface 2 and parallel to the guide tracks 8. These two longitudinal bars $\mathbf{5}_2$ and $\mathbf{5}_3$ are connected together at their ends by connection bars $\mathbf{5}_1$ and $\mathbf{5}_4$ (not shown) so that together they form a frame defining the surface 2. One of the connection bars $\mathbf{5}_4$ defines the abutment edge for the longitudinal edge $\mathbf{3}_a$ of the first slat, while the other bar $\mathbf{5}_1$ defines the stowage edge for the longitudinal edge of the last slat 3.

The first slat and the last slat should be counted in the deployment direction of the slats as represented by the arrow F whereby the slats go from the stowed position to the deployed position. When the slats 3 are returned in the direction $F_1$ opposite to the direction F, the first and last slats should be considered as being the same slats as those specified for the deployment operation. In general manner, the installation has a series of adjustable slats 3 comprising odd-numbered slats $\mathbf{3}_1, \mathbf{3}_3, \mathbf{3}_5, \ldots, \mathbf{3}_i$, including the first slat $\mathbf{3}_1$ which is also referred to as the "head" slat as explained in the description below. This series of slats 3 also has even-numbered slats $\mathbf{3}_2, \mathbf{3}_4, \mathbf{3}_6, \ldots \mathbf{3}_{i+1}$, interposed between the odd-numbered slats so as to obtain an alternation of even-numbered slats followed by odd-numbered slats, with the slat numbers increasing starting from the "head" slat. Naturally, the number of even-numbered slats and the number of odd-numbered slats may be identical or they may differ by unity, depending on the dimensions of the surface to be covered.

The installation 1 of the invention is for fastening by any appropriate means on a carrier structure (not shown) adapted to the intended application. When the installation 1 of the invention is to form the roof of a pergola, for example, the carrier structure 5 may be fastened on walls or it may be provided with posts supporting the frame made up of the connection bars and of the longitudinal bars.

In accordance with the invention, each slat 3 is supported at each of its ends, and more precisely via its pivot pins 4, by a set of two carriages, namely a first carriage $\mathbf{10}_1$ and a second carriage $\mathbf{10}_2$, which carriages are guided in translation along the guide tracks 8. As can be seen more clearly in FIGS. 4 and 5, each slat 3 is thus supported by its pivot axes 4 with the help of two carriages $\mathbf{10}_1$ and $\mathbf{10}_2$ that move in translation along the guide tracks between the stowed position and the deployed position. For convenience, it is considered that all of the first carriages $\mathbf{10}_1$ of the slats co-operate with the same guide track, i.e. are positioned at the same longitudinal side of the surface 2, while all of the second carriages $\mathbf{10}_2$ of the slats co-operate with the other guide track, i.e. by being positioned along the other longitudinal side of the surface 2.

For this purpose, each carriage $\mathbf{10}_1$, $\mathbf{10}_2$ has a guide system 11 that co-operates with a guide track 8. In the embodiment shown, the guide system 11 comprises a wheel $\mathbf{11}_a$ carried by each carriage and co-operating with a slot arranged in the carrier structure 5 and forming the guide track 8. Naturally, the guide system 11 could be made in some other way.

In accordance with the invention, the movement system II includes, for each pair of carriages $\mathbf{10}_1$, $\mathbf{10}_2$ fitted to a "head" slat $\mathbf{3}_1$, two movement motors 12 each carried on a different carriage. It should be understood that a slat is said to be a "head" slat $\mathbf{3}_1$ if it is motor-driven at both of its ends by respective motors so as to balance the forces applied to the slat. In the preferred embodiment shown in the drawings (with the exception of FIG. 7), the movement system II has a single slat $\mathbf{3}_1$ referred to as the "head" slat, for which each of the carriages $\mathbf{10}_1$, $\mathbf{10}_2$ carries a respective movement motor 12 (FIGS. 4, 6).

Figure 7:
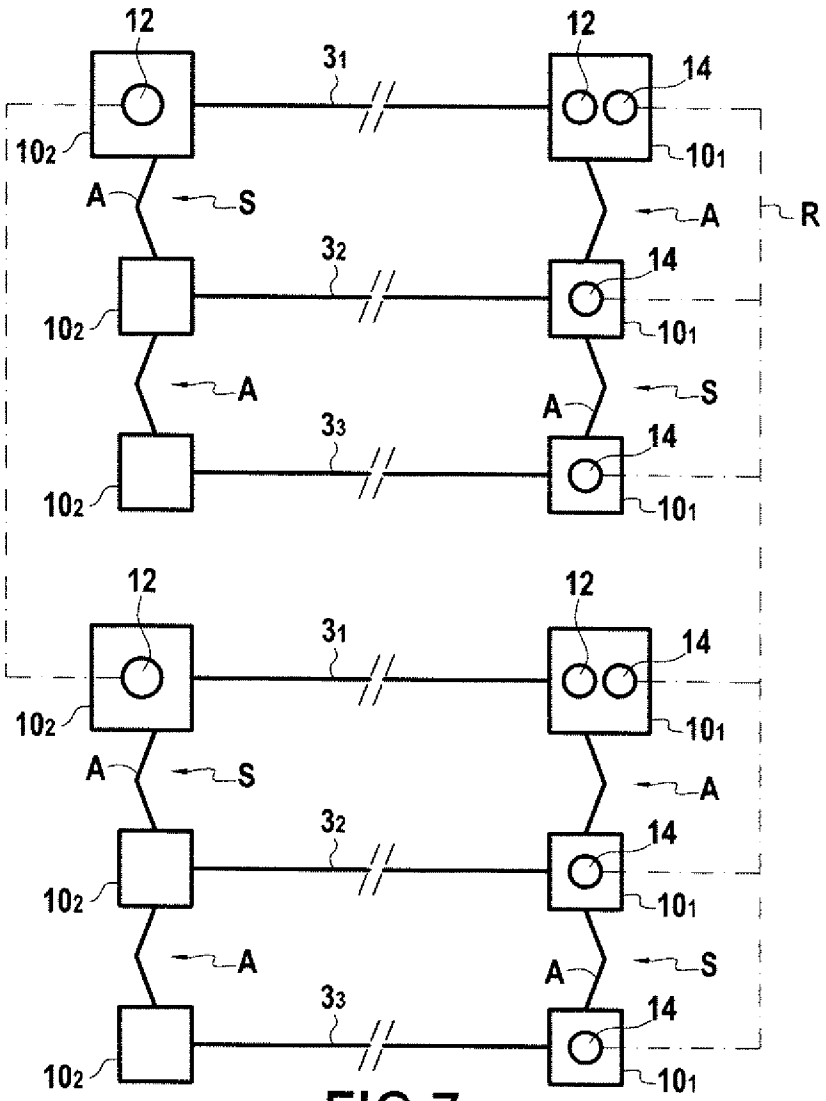
FIG. 7 is a diagram showing a second embodiment of coupled carriages in an installation in accordance with the invention.

In the embodiment shown in FIG. 7, the movement system II has a plurality of "head" slats 3, i.e. two in the example shown, for which each of the carriages $\mathbf{10}_1$, $\mathbf{10}_2$ is fitted with a movement motor 12. It should be observed that when the movement system II has a plurality of "head" slats $\mathbf{3}_1$, the odd-numbered slats $\mathbf{3}_3, \mathbf{3}_5, \ldots, \mathbf{3}_i$ and the even-numbered slats $\mathbf{3}_2, \mathbf{3}_4, \mathbf{3}_6, \ldots, \mathbf{3}_{i+1}$ are counted starting from each "head" slat $\mathbf{3}_1$. Thus, in the embodiment shown in FIG. 7, the installation has two groups of slats $\mathbf{3}_1$, $\mathbf{3}_2$, $\mathbf{3}_3$, each group having a "head" slat $\mathbf{3}_1$ and an even-numbered slat arranged between two odd-numbered slats, with the numbering of the slats beginning with and increasing from each "head" slat. In the embodiment shown in FIG. 6, the installation has only one group of slats, each having only one "head" slat $\mathbf{3}_1$.

For each even-numbered slat $\mathbf{3}_2, \mathbf{3}_4, \mathbf{3}_6, \ldots \mathbf{3}_{i+1}$ forming part of a group of slats, the movement system II includes firstly a retractable coupling 1 fastened between the first carriage $\mathbf{10}_1$ of said slat and the first carriage $\mathbf{10}_1$ belonging to the head slat or to the neighboring lower-numbered slat, and secondly a drive system S for driving the second carriage $\mathbf{10}_2$ of said slat in translation. As explained in detail in the description below, a retractable coupling A is suitable for occupying firstly a "coupling" or "towing" first position in which two neighboring carriages are mechanically coupled together so that deploying one carriage in one direction leads to the neighboring carriage moving in the same direction, and secondly a "retraction" second position in which moving one carriage does not cause the other carriage to move. This retractable coupling A is implemented between two first carriages $\mathbf{10}_1$ belonging to two neighboring slats or between two second carriages $\mathbf{10}_2$ belonging to two likewise neighboring slats.

Figure 6:
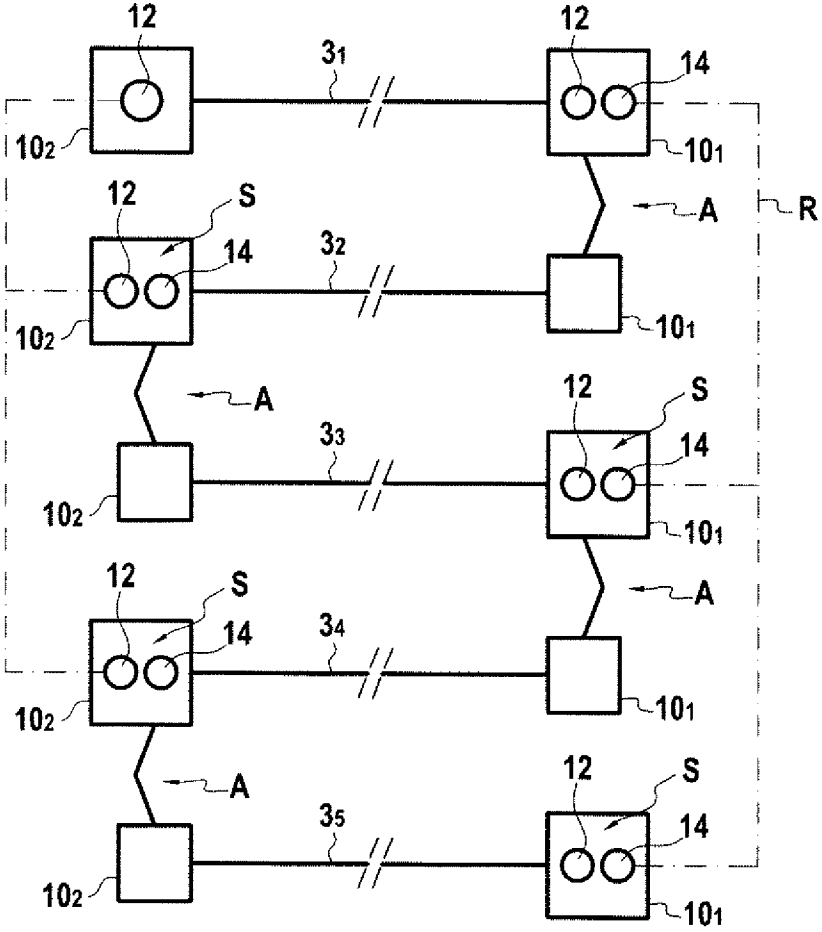
FIG. 6 is a diagram showing a first embodiment of coupled carriages in an installation in accordance with the invention.

Thus, in the embodiment shown in FIG. 6, a retractable coupling A is fastened between the first carriage $\mathbf{10}_1$ of slat number $\mathbf{3}_2$ and the first carriage $\mathbf{10}_1$ belonging to the head slat $\mathbf{3}_1$, while a retractable coupling A is fastened between the first carriage $\mathbf{10}_1$ of slat number $\mathbf{3}_4$ and the first carriage $\mathbf{10}_1$ belonging to the neighboring slat of lower number, i.e. $\mathbf{3}_3$. In the embodiment shown in FIG. 7, a retractable coupling A is fastened for each group of slats between the first carriage $\mathbf{10}_1$ of the slat of number $\mathbf{3}_2$ and the first carriage $\mathbf{10}_1$ belonging to the head slat $\mathbf{3}_1$. Naturally, when a group of slats includes other even-numbered slats, a retractable coupling A is fastened between the first carriage $\mathbf{10}_1$ of each even-numbered slat and the first carriage $\mathbf{10}_1$ belonging to the neighboring slat of lower number.

Furthermore, for each even-numbered slat $\mathbf{3}_2$, $\mathbf{3}_4$, $\mathbf{3}_6$, . . . , $\mathbf{3}_{i+1}$ forming part of a group of slats, each second carriage $\mathbf{10}_2$ of each of the slats is fitted with a drive system S for driving the second carriage $\mathbf{10}_2$ in translation. In accordance with the invention, each drive system S for driving a second carriage $\mathbf{10}_2$ in translation comprises either a movement motor 12 on board said second carriage (FIG. 6), or else a retractable coupling A fastened between the second carriage $\mathbf{10}_2$ of said slat and the second carriage $\mathbf{10}_2$ of the neighboring slat of lower number (FIG. 7).

Thus, in the embodiment shown in FIG. 6, each of the second carriages $\mathbf{10}_2$ of the even-numbered slats $\mathbf{3}_2$, $\mathbf{3}_4$ is fitted as its translation drive system S with a movement motor 12 on board each of said carriages $\mathbf{10}_2$. In the embodiment shown in FIG. 7, each of the second carriages $\mathbf{10}_2$ of the even-numbered slat $\mathbf{3}_2$ of each group of slats is fitted as its translation drive system S with a retractable coupling A fastened between the second carriage $\mathbf{10}_2$ of said even-numbered slat $\mathbf{3}_2$ and the second carriage $\mathbf{10}_2$ of the neighboring slat of lower number, i.e. the head slat. Naturally, when a group of slats includes other even-numbered slats, a retractable coupling A is fastened between the second carriage $\mathbf{10}_2$ of each even-numbered slat and the second carriage $\mathbf{10}_2$ belonging to the neighboring slat of lower number.

It should thus be understood that each even-numbered slat $\mathbf{3}_2$, $\mathbf{3}_4$, $\mathbf{3}_6$, . . . , $\mathbf{3}_{i+1}$ is motor-driven at both of its ends, either by a drive motor 12 and by a retractable coupling A (FIG. 6), or else by means of two retractable couplings A (FIG. 7). Whatever the solution that is selected, each even-numbered slat is thus motor-driven at both ends, thereby enabling the forces applied to the slat to be balanced.

According to another characteristic of the invention, the movement system II includes, for each odd-numbered slat $\mathbf{3}_3$, $\mathbf{3}_5$, . . . , $\mathbf{3}_i$ (not including the head slat $\mathbf{3}_1$), a retractable coupling A fastened between the second carriage $\mathbf{10}_2$ of said slat and the second carriage $\mathbf{10}_2$ belonging to the neighboring slat of lower number together with a drive system S for driving the first carriage $\mathbf{10}_1$ of said slat in translation.

Thus, in the embodiment shown in FIG. 6, a retractable coupling A is fastened between the carriage $\mathbf{10}_2$ of the slat of number $\mathbf{3}_3$ and the second carriage $\mathbf{10}_2$ belonging to the slat $\mathbf{3}_2$ of lower number, while a retractable coupling A is fastened between the second carriage $\mathbf{10}_2$ of the slat of number $\mathbf{3}_5$ and the second carriage $\mathbf{10}_2$ belonging to the neighboring slat of lower number, i.e. $\mathbf{3}_4$. In the embodiment shown in FIG. 7, a retractable coupling A is fastened, for each group of slats, between the second carriage $\mathbf{10}_2$ of the slat of number $\mathbf{3}_3$ and the second carriage $\mathbf{10}_2$ belonging to the neighboring slat of lower number, i.e. the slat of number $\mathbf{3}_2$. Naturally, when a group of slats includes other odd-numbered slats, a retractable coupling A is fastened between the second carriage $\mathbf{10}_2$ of each odd-numbered slat and the second carriage $\mathbf{10}_2$ belonging to the neighboring slat of lower number. Conversely, it should be observed that it is possible to envisage making at least one group of slats that does not include any odd-numbered slat (that does not include the head slat).

Furthermore, for each odd-numbered slat $\mathbf{3}_3$, $\mathbf{3}_5$, . . . , $\mathbf{3}_i$ (not including the head slat $\mathbf{3}_1$), forming part of a group of slats, each first carriage $\mathbf{10}_1$ of each of the slats is fitted with a drive system S for driving the first carriage $\mathbf{10}_1$ in translation. In accordance with the invention, each drive system S for driving a first carriage $\mathbf{10}_1$ in translation comprises either a movement motor 12 on board said first carriage $\mathbf{10}_1$ (FIG. 6), or else a retractable coupling A fastened between the first carriage $\mathbf{10}_1$ of said slat and the first carriage $\mathbf{10}_1$ of the neighboring slat of lower number (FIG. 7).

Thus, in the embodiment shown in FIG. 6, each of the first carriages $\mathbf{10}_1$ of the slats of odd number $\mathbf{3}_3$, $\mathbf{3}_5$, . . . , $\mathbf{3}_i$ (not including the head slat $\mathbf{3}_1$) is fitted as its translation drive system S with a movement motor 12 on board each of said first carriages $\mathbf{10}_1$. In the embodiment shown in FIG. 7, each of the first carriages $\mathbf{10}_1$ of the odd-numbered slats $\mathbf{3}_3$ of each group of slats is fitted as its translation drive system S with a retractable coupling A fastened between the first carriage $\mathbf{10}_1$ of said odd-numbered slat $\mathbf{3}_3$ and the first carriage $\mathbf{10}_1$ of the neighboring slat of lower number, i.e. the slat of number $\mathbf{3}_3$.

It should also be understood that each odd-numbered $\mathbf{3}_3$, $\mathbf{3}_5$, . . . , $\mathbf{3}_i$ (not including the head slat $\mathbf{3}_1$) is motor-driven at each of its two ends, either by a movement motor 12 and by a retractable coupling A (FIG. 6), or else by two retractable couplings A (FIG. 7). Whatever the solution selected, each odd-numbered slat is motor-driven at both ends, thereby enabling the forces that are applied to the slats to be balanced. It should be observed that in the embodiment shown in FIG. 6, each movement motor 12 is dimensioned to move only one slat in translation, whereas in the embodiment shown in FIG. 7, the movement motors 12 fitted to each head slat are dimensioned to drive in translation all of the slats forming part of a group.

For example, the movement motors 12 are electric motors, e.g. direct current (DC) motors with brushes, connected to an electrical power supply and to a control device via connection cables R shown in chain-dotted lines in FIGS. 6 and 7.

It can be seen from the above description that the slats 3 are self-propelled.

In the preferred embodiment shown in FIG. 6, the movement system II has a single head slat $\mathbf{3}_1$ together with even-numbered and odd-numbered slats forming successive pairs of slats, each of which has a slat in common, i.e. the following successive pairs $\mathbf{3}_1$-$\mathbf{3}_2$, $\mathbf{3}_2$-$\mathbf{3}_3$, $\mathbf{3}_3$-$\mathbf{3}_4$, . . . , $\mathbf{3}_i$-$\mathbf{3}_{i+1}$. Retractable couplings A are mounted in alternating manner between the first carriages and the second carriages of successive pairs of slats. Thus, between the first pair of slats ($\mathbf{3}_1$ and $\mathbf{3}_2$), a retractable coupling A is mounted between the first carriages $\mathbf{10}_1$ of the slats, whereas between the second pair of slats ($\mathbf{3}_2$ and $\mathbf{3}_3$), a retractable coupling A is mounted between the second carriages $\mathbf{10}_2$ of these slats, and so on.

In the embodiment shown in FIG. 7, the movement system II has a plurality of head slats $\mathbf{3}_1$ each driving at least one slat so as to form a group of slats, these groups of slats not being connected together.

According to a characteristic of the invention, each slat 3 may also be adjusted in inclination individually. Thus, the adjustment system I in a preferred embodiment comprises, for each pair of carriages fitted to a slat, at least one, and in the example shown only one, adjustment motor 14 on board one of the two carriages $\mathbf{10}_1$ and $\mathbf{10}_2$ fitted to a slat 3. Each adjustment motor 14 is angularly connected with a pivot pin 4 in order to place the slat 3 in a determined angular position that may be erect (perpendicular to the surface 2, i.e. vertical for a pergola), or closed (in the horizontal position), or intermediate between the vertical and horizontal positions. Naturally, each slat could be adjusted in some other way.

In the preferred embodiment shown in the figures (excluding FIG. 7), an adjustment motor 14 is mounted for each slat preferably on the carriage that carries a movement motor 12 (except for the head slat for which the adjustment motor is placed on one or the other of the two motor-driven carriages). These carriages carrying both a movement motor 12 and an adjustment motor 14 are said to be motor-driven, whereas the other carriages that do not have any motor are said to be towed. The motor-driven carriages and the towed carriages are mounted in alternation from one slat to another on each side of the surface 2 that is to be covered or uncovered. In other words, the first carriages $\mathbf{10}_1$ comprise motor-driven carriages and towed carriages in alternation along one longitudinal side of the carrier structure. Likewise, the second carriages $\mathbf{10}_2$ comprise both motor-driven carriages and towed carriages in alternation along the other longitudinal side of the carrier structure, but offset by one slat relative to the first carriages. Such an arrangement makes it possible to limit the number of motors, while also allowing each slat to be motor-driven at both ends. This solution also makes it possible to save space, in particular in the stowed position, as explained in the description below.

Figure 8:
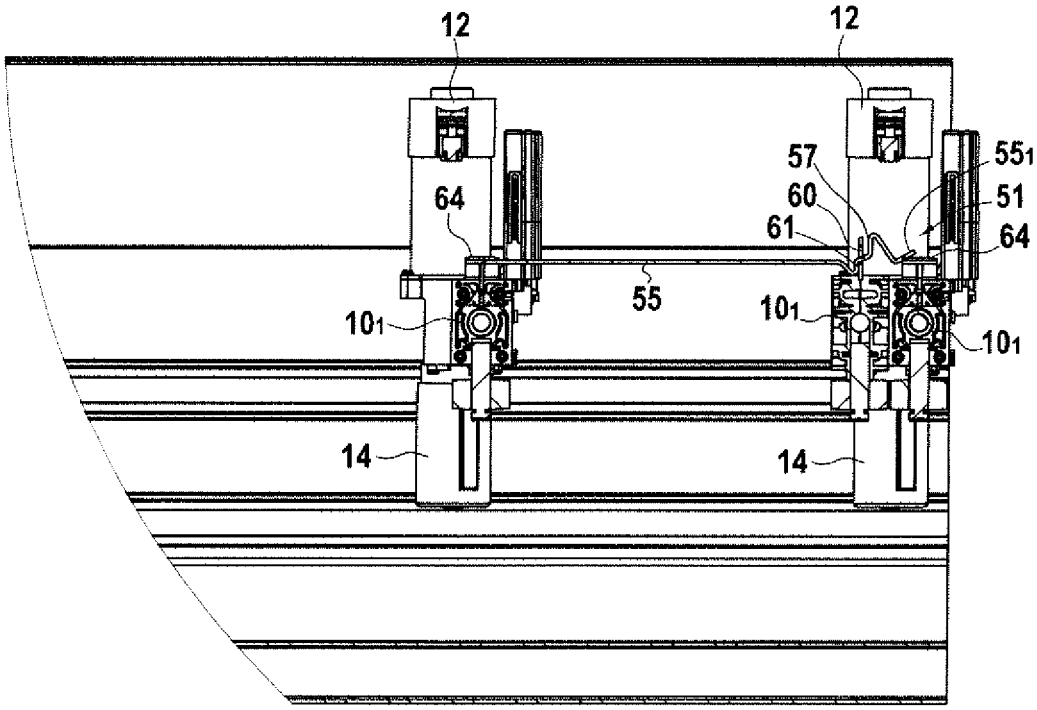
FIGS. 8 and 9 are respectively an elevation view and a plan view showing the operation of retracting the couplings connecting the slats together.
Figure 9:
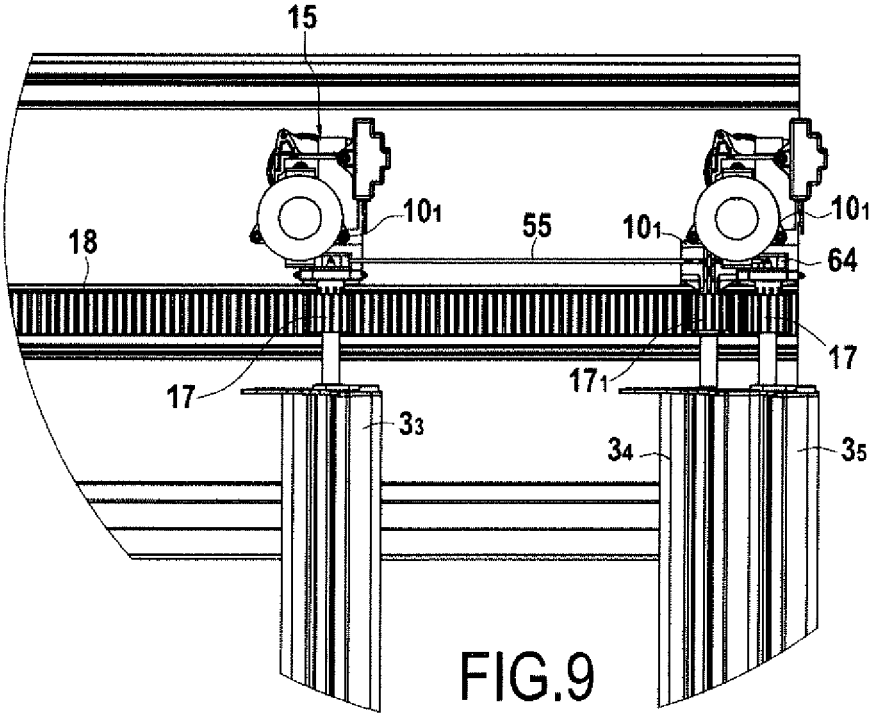

Each carriage $\mathbf{10}_1$, $\mathbf{10}_2$ presents a main body 15 generally in the form of an elongate rectangular parallelepiped extending mainly along the pivot pin 4. Preferably, the bodies 15 of the motor-driven carriages and of the towed carriages are not identical, specifically in order to save space in the stowed position. As can be seen more clearly in FIGS. 4 and 5, the main body 15 of a non-motor-driven carriage (carriage $\mathbf{10}_2$ in FIG. 5), possess a length in the direction in which the slats 3 extend that is shorter than the length of the main body of a towed carriage (carriage $\mathbf{10}_1$ in FIG. 5). Specifically, the movement motor 12 is mounted at the end of the main body 15 of a motor-driven carriage, thus enabling the main body 15 to present a shape that is shortened in order to receive the main body of another carriage $\mathbf{10}_1$. Thus, and as can be seen in FIGS. 8 and 9, the main body 15 of a first towed carriage $\mathbf{10}_1$ of a slat $\mathbf{3}_4$ can engage between the first motor-driven carriages of two neighboring slats $\mathbf{3}_3$, $\mathbf{3}_5$, thereby enabling the carriages to be stowed touching one another.

Naturally, each movement motor 12 is mounted in any suitable manner on the main body 15 of each motor-driven carriage $\mathbf{10}_1$, $\mathbf{10}_2$. The movement motors 12 are connected to mechanisms for transforming the rotary motion of the motor into movement in translation of the slats in a direction parallel to the guide track 8. In the embodiment shown, each mechanism for transforming the rotary motion of the motor comprises a gearwheel 17 driven in rotation by a movement motor 12. Each gearwheel 17, which specifically carries the weight of the carriage, co-operates with a rack 18 mounted on the carrier structure 5 in a direction parallel to the guide track 8 and along the entire length of the guide track so as to enable the slats to move in translation between their stowed and deployed positions. In an advantageous variant embodiment, each rack 18 is constituted by a cog belt fastened to the carrier structure 5.

It should be observed that each "towed" carriage $\mathbf{10}_1$, $\mathbf{10}_2$ is provided with a gearwheel $\mathbf{17}_1$ co-operating with a rack 18. Each gearwheel $\mathbf{17}_1$ of a towed carriage, which specifically supports the weight of the carriage, has a pivot pin 4 of the slat passing freely therethrough. It should be observed that in the embodiment shown in FIG. 7, all of the carriages of the slats, excepting the carriages of the head slats, are also considered as being towed carriages.

In the embodiment shown in the drawings (FIG. 5), each rack 18 is mounted on the top face of a middle partition 5*a* presented by each longitudinal bar $\mathbf{5}_2$, $\mathbf{5}_3$. In this example, each longitudinal bar $\mathbf{5}_2$, $\mathbf{5}_3$ presents a web 5*b* extending horizontally and from which there extends upwards the middle partition 5*a* and on either side thereof an outer flange 5*c* and an inner flange 5*d*. The middle partition 5*a* is fitted with the guide track 8 made under the outer face receiving the rack 18.

According to a characteristic of the invention, each longitudinal bar $\mathbf{5}_2$, $\mathbf{5}_3$ is made by extrusion. The bars may be assembled end to end as desired in order to match the dimensions of the surface 2 for covering. Advantageously, the middle partition 5*a* and the inner flange 5*d* define between them a gutter 5*e* with the end edges of the slats extending vertically thereover, so as to be able to recover rain water, if any.

The longitudinal bars $\mathbf{5}_2$, $\mathbf{5}_3$, which are open, may advantageously be closed by means of a cover 19 that protects the carriages and that is mounted between the outer flange 5 and the middle partition 5*a*. The cover 19 has brushes $\mathbf{19}_1$ (FIG. 5) adjusted to allow the pivot pins 4 to pass through.

Figure 5:
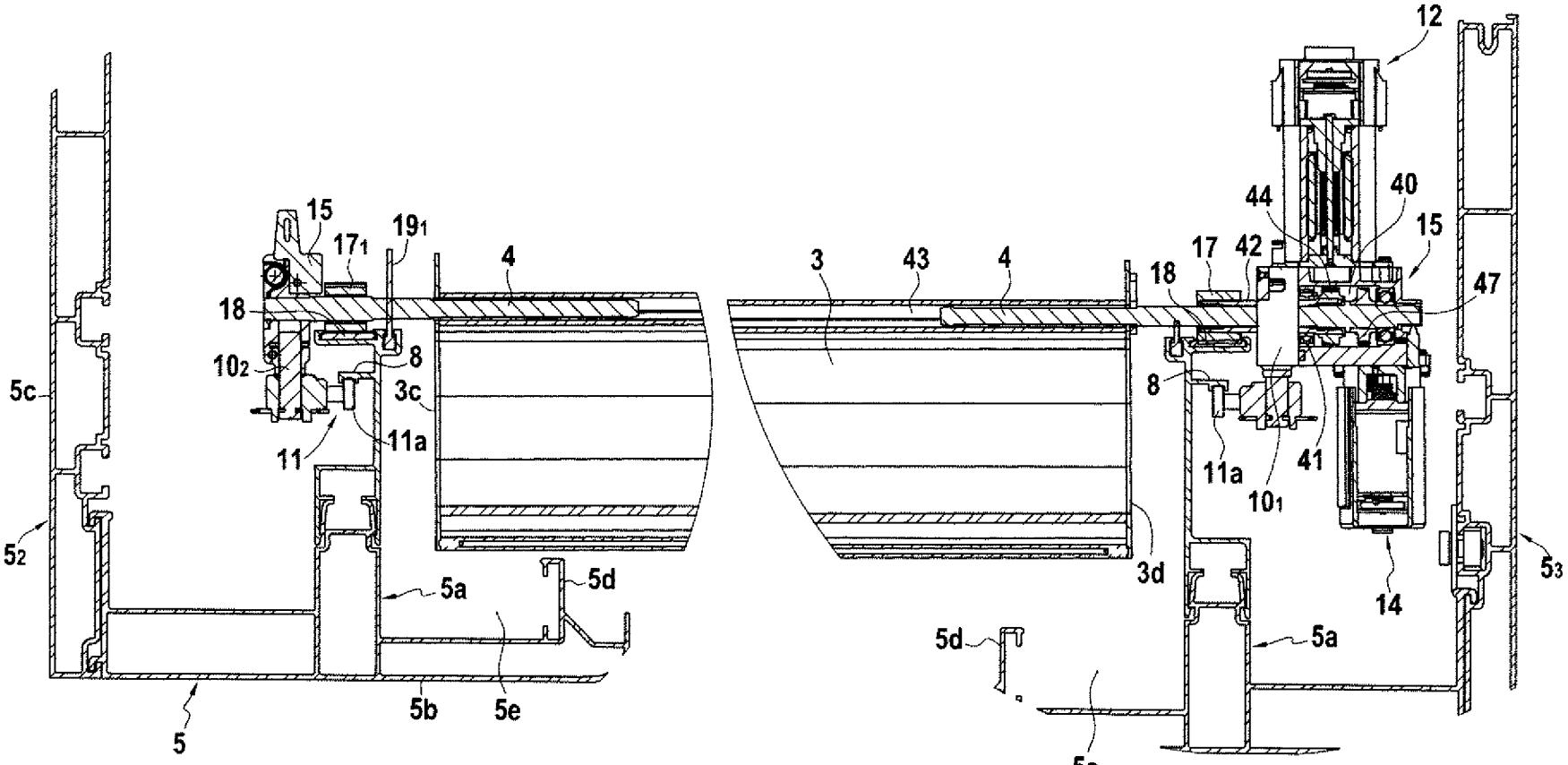
FIG. 5 is an elevation section view showing how a slat is mounted.

As can be seen more clearly in FIG. 5, each carriage $\mathbf{10}_1$, $\mathbf{10}_2$ carrying both a movement motor 12 and an adjustment motor 14 includes a bore 40 fitted with a rotary guide system 41 for a tubular shaft 42 having freely engaged therein a pivot pin 4 that projects from a housing 43 provided in the end of the slat. A gearwheel 17 that co-operates with the rack 18 is angularly connected to the tubular shaft 42, which is itself driven in rotation by a toothed wheel 44 fastened on the tubular shaft 42 and meshing with the outlet shaft of the movement motor 12.

Rotation of the tubular shaft 42 leads to the carriage $\mathbf{10}_1$, $\mathbf{10}_2$ moving in translation, thereby moving in translation the slat having its pivot pin 4 pushed by the movement in translation of the carriage. Each gearwheel 17 co-operates indirectly with a pivot pin 4 in order to drive the pivot pin 4 of the slat 3 in translation via the pivot connection made between the tubular shaft 42 and the pivot pin 4.

Furthermore, the pivot pin 4 is driven in rotation by the adjustment motor 14 having its outlet shaft co-operating with a toothed wheel 47 that is constrained to move in rotation with the pivot pin 4 having its opposite end engaged inside the housing 43 and angularly connected to the slat by any appropriate means, e.g. connecting dowels. The pivot pin 4 is thus mounted to turn freely inside the tubular shaft 42 and its inclination can be adjusted at will to occupy a determined stable position by using the adjustment motor 14.

It should be observed that in the embodiment shown in FIG. 7, the adjustment motors 14 mounted on the towed carriages are connected to the pivot pins 4 as described above, i.e. the output shaft from each adjustment motor 14 co-operates with the pivot pin that is angularly connected to the slat.

The movement system II for moving the slats 3 thus serves to move the slats between a stowed position in which the slats 3 touch one another and a position in which they are partially or completely deployed in register with the surface 2. In the deployed position, two consecutive or adjacent slats 3 are spaced apart at a determined deployment pitch that enables said two slats to co-operate with each other to close the corresponding surface when the slats are positioned by the adjustment mechanism I at a closure angle of inclination.

As explained above, two consecutive slats 3 are at least connected together by at least one retractable coupling A. In accordance with the invention, each retractable coupling A provides movement in translation between two adjacent carriages by means of a mechanical connection such that one of the carriages exerts on the other carriage a traction force during deployment of the slats, as represented by arrow F, or else a thrust force during the return of the slats 3 in the direction $F_1$.

Nevertheless, the slat of lower number exerts its traction force on the following slat only when the slat of lower number has been moved through the determined deployment pitch. Between its stowed position and its deployment at the determined pitch, this slat of lower number does not entrain movement in translation of the following slat. In similar manner, the slat of lower number exerts its thrust force on the following slat so long as it does not occupy its stowed position.

Specifically, as soon as this slat occupies its stowed position, the slat of lower number no longer drives the following slat to move in translation.

As can be seen in FIGS. 8 to 11, each retractable coupling A between the first carriages $\mathbf{10}_1$ or the second carriages $\mathbf{10}_2$ of a slat having a number and a slat having a lower number thus includes firstly a locking mechanism 50 for locking the coupling in a towing position when the lower-numbered slat has been moved through a determined deployment pitch, and secondly an unlocking mechanism 51 for unlocking the locking mechanism 50 in order to place the coupling in a retracted position and acting as soon as the slat of given number occupies its stowed position.

Thus, as soon as the slat of a lower number has been moved through the deployment pitch, the coupling A is locked by the mechanism 50 in a towing position in order to pull the following slat. Conversely, as soon as the slat of given number occupies its stowed position, the coupling A is unlocked by the locking mechanism 51 so that the slat of lower number can move into its stowed position, where it touches the slat of given number.

In a first variant embodiment as shown in FIGS. 8 to 11, each retractable coupling A between the carriages of a slat of given number and a slat of lower number has, as its locking mechanism 50 for locking the coupling in a towing position, a towbar 55 carried by the carriage of the slat of lower number. In a preferred variant embodiment, the towbar 55 is made by a flexible rod that is fastened to each carriage of lower number and that extends towards and at least as far as the neighboring carriage of given number when the two carriages are spaced apart by the deployment pitch. In the preferred embodiment of FIG. 6, the towbar 55 is fastened on a motor-driven carriage in order to co-operate with a neighboring towed carriage.

Figure 10:
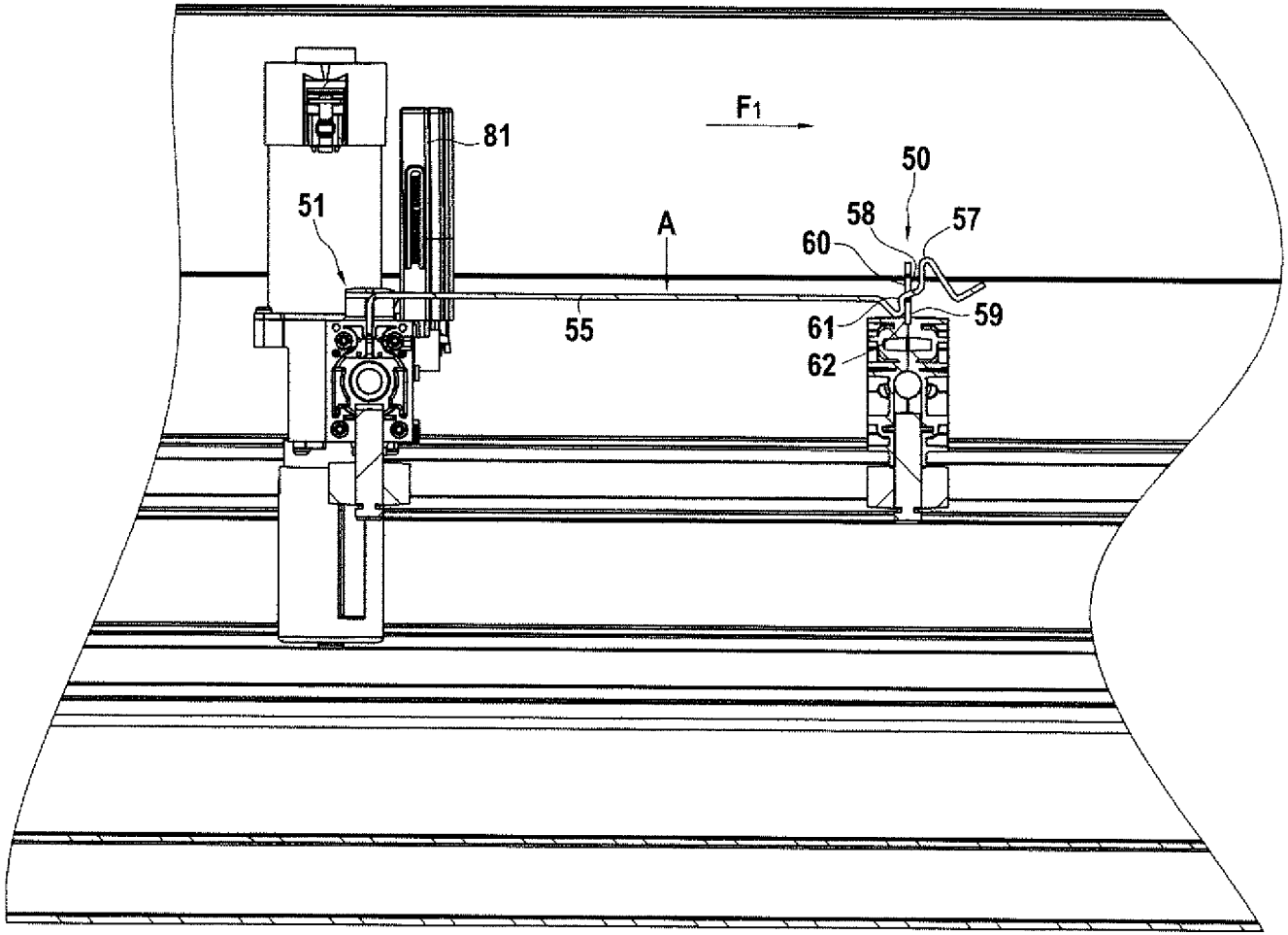
FIGS. 10 and 11 are elevation views showing a coupling, respectively exerting thrust forces and traction forces on a neighboring slat.

Each towbar 55 is arranged to present a traction surface 57 that is to co-operate with a first abutment 58 carried by the carriage of the slat of given number (neighboring towed carriage) only when the slat of lower number has moved through its determined deployment stroke and during the operation of deploying said slat (FIG. 10). In the example shown, the first abutment 58 is made by a face of a plate 59 fastened to the carriage and facing away from the carriage of lower number. The plate 59 has an opening 60 through which the towbar 55 passes, which towbar always remains engaged through this opening 60 on passing from the retracted position to the towing position, and vice versa.

Each towbar 55 is also arranged to present a thrust surface 61 that is to co-operate with a second abutment 62 carried by the carriage of the slat of given number (neighboring tow carriage), so long as said slat of given number has not reached its stowed position during the operation of stowing said slat. In the example shown, the second abutment 62 is constituted by the opposite face of the plate 59 forming the first abutment 58.

As can be seen clearly in FIGS. 8 to 12, the traction and thrust surfaces 57 and 61 are made by bends formed in the rod 55 so that it presents portions that extend transversely relative to the general direction in which the rod 55 extends.

When the slat of given number has reached its stowed position, each towbar 55 co-operates with the mechanism 51 for unlocking the locking mechanism 50 in order to eliminate contact between the thrust surface 61 and the second abutment 62 so that the slat of lower number can move until it reaches its stowed position. In the example shown, the unlocking mechanism 51 is carried by each motor-driven carriage in such a manner that the towbar 55 carried by a motor-driven carriage serves to co-operate with the mechanism carried by the neighboring motor-driven carriage of higher number that has already been stowed (and between which a towing carriage is positioned). The unlocking mechanism 51 is also mounted on the stowage side $\mathbf{5}_1$ of the carrier structure 5 in order to co-operate with the locking mechanism 50 of the last slat but one.

Figure 18:
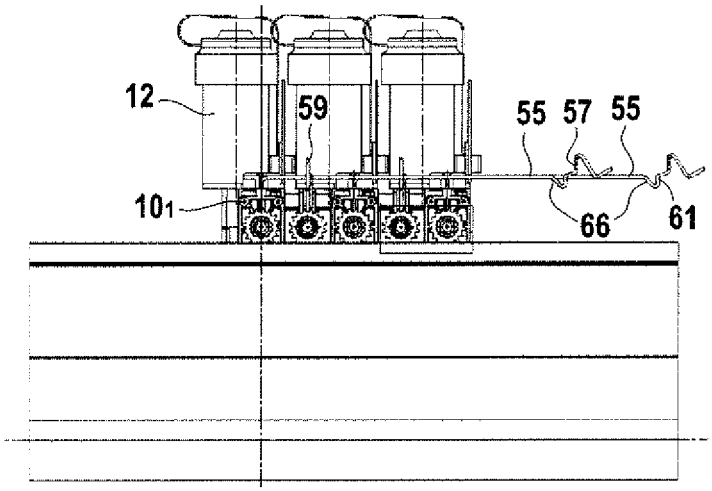
FIG. 18 is a diagrammatic section view in elevation showing certain slats in a stowed position.

For example, the unlocking mechanism 51 is constituted by a ramp 64 serving to lift the end $\mathbf{55}_1$ of the towbar (FIG. 8) during the movement of the motor-driven carriage in the return direction so that the thrust surface 61 can escape from the second abutment 62 by passing through the through opening 60 so that the carriage of lower number can continue to move in translation towards its stowed position. Thus, and as shown in FIG. 18, in the stowed position the carriages can be touching one another with the towbars 55 being in a retracted position and extending one beside another. Each ramp 64 that is carried by a carriage may be fastened with the possibility of moving backwards or forwards through the unlocking distance between two neighboring carriages.

It should be observed that in the retraced position, each towbar 55 possesses its thrust surface 61 that has been pushed beyond the plate 59. Preferably, each thrust surface 61 is extended away from the free end $\mathbf{55}_1$ of the towbar 55 by a ramp 66 that acts, while the carriages are moving in the deployment position F, to enable the thrust surface 61 to pass easily through the through opening 60. Specifically, while moving in translation in the deployment direction F, co-operation between the ramp 66 and the plate 59 leads to the towbar 55 being lifted so as to allow the thrust surface to pass to the other side of the plate 59. The towbar 55 then occupies a neutral position in which the traction surface 57 is positioned facing the first abutment 58, thus preventing the two carriages from being mutually disassembled. It is clear that each towbar 55 possesses flexing ability so as to be able to pass from an abutment position to a retracted position and back again.

According to an advantageous embodiment characteristic, each retractable coupling A between the first carriages or the second carriages of a slat of given number and a slat of lower number has a keeper system 70 for keeping the slat of given number in position so long as the slat of lower number has not been moved through its determined deployment stroke (FIGS. 12 to 15). This keeper system 70 serves to keep the slat in the stowed and prevent this stowed slat from being able to move under the action of the retractable coupling during movement of a slat of lower number.

Furthermore, each retractable coupling A between the first carriages or the second carriages of a slat of given number neighboring a slat of a lower number includes an unlocking system 71 for unlocking the keeper system 70 as soon as the slat of lower number has been moved through its deployment stroke. Thus, as soon as the slat of lower number has been moved through its deployment stroke, the slat of lower number can act via the coupling A to move the slat of following number in translation.

In a preferred embodiment, each retractable coupling A includes, as its system 70 for keeping a slat of lower number in position, a spring rod 73 carried by a carriage of said slat of lower number and co-operating with a catch 74 placed on a neighboring carriage of a slat of given number. It should be observed that the stowage edge $\mathbf{5}_1$ of the carrier structure 5 is also provided with a catch 74 for co-operating with the spring rod 73 of the carriage of the first stowed slat. Each spring rod 73 presents a shape or fold 75 that is adjusted firstly to become blocked behind the catch 74 and secondly to be released from the catch under the action of the traction force exerted by the slat of lower number. Naturally, the spring rod 73 presents ability for elastic deformation so as to be able to pass from its blocking position (FIGS. 14 and 15) to its unblocked position (FIGS. 12 and 13), by pivoting in a plane.

Figure 16:
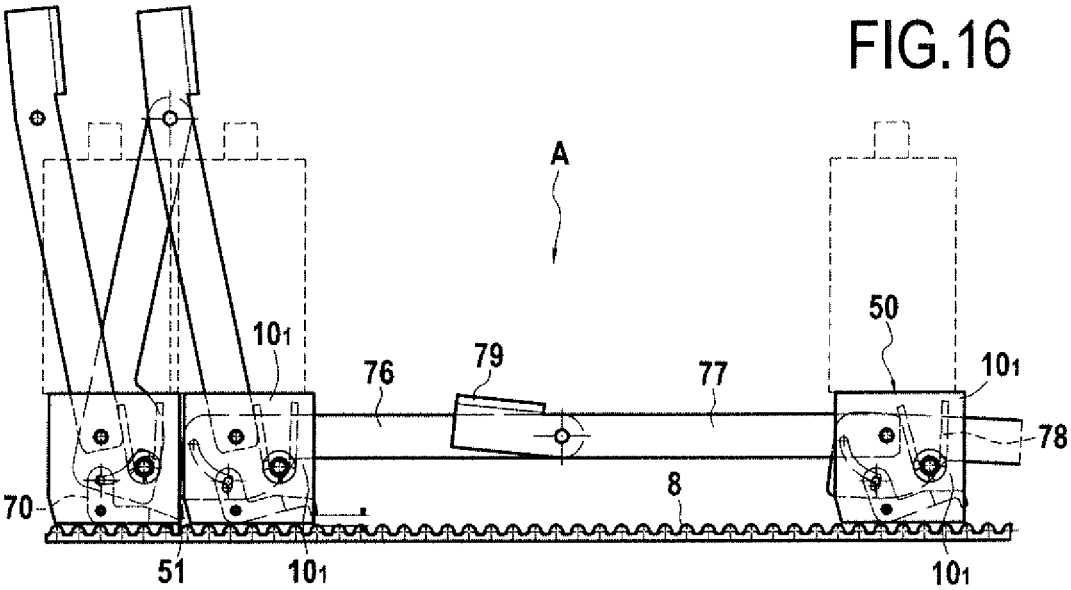
FIGS. 16 and 17 are elevation views showing another variant embodiment of a retractable coupling in accordance with the invention.
Figure 17:
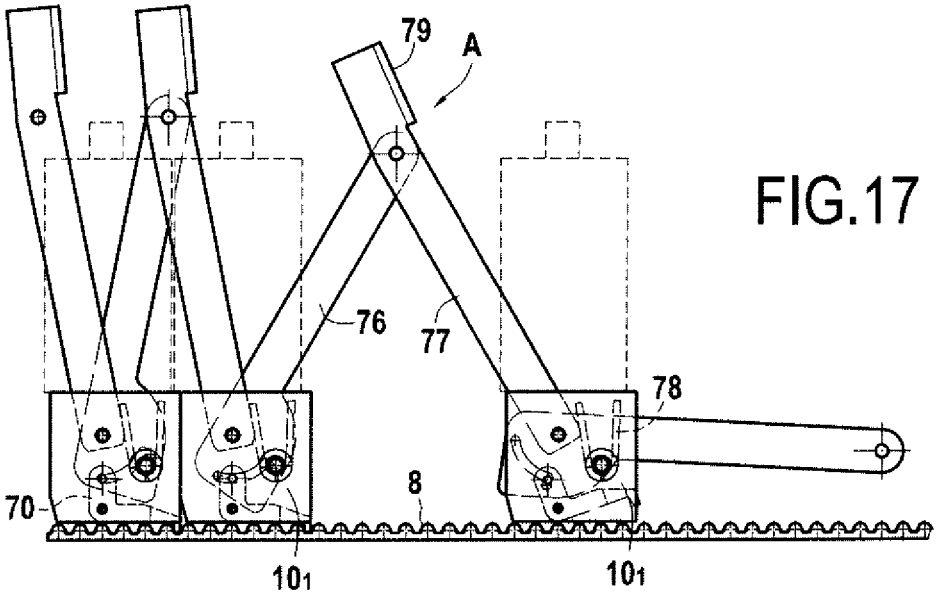

FIGS. 16 and 17 show another variant embodiment of the retractable coupling A. In this variant embodiment, each retractable coupling A between the neighboring carriages of a slat of given number and a slat of lower number comprise two hinged links 76, 77 so as to form, in association with the coupling locking mechanism 50, a scissors linkage that is incompressible in the towing position. These two links 76, 77 are hinged to the carriages and they are hinged to each other. The locking mechanism 50 has a spring member 78 acting on one of the links in order to ensure contact with an abutment 79 carried by one of the links so as to form a rigid linkage. During deployment of a slat, one of the links comes to bear against the carriage of the slat that has already been stowed so as to form a flexible scissors linkage under the action of such an unlocking mechanism 51, thereby enabling the coupling to be placed in a retracted position. It should be observed that one of the links 76 acts on a keeper mechanism 70 for blocking a slat in position and formed by a latch that is urged resiliently to co-operate with the rack 8.

The installation 1 also has sensors (not shown) for sensing the positions and the movements of the slats 3. Such sensors serve to determine the positions of each of the slats 3 at all times along their travel along the guide track. Such position and movement sensors may be made in any appropriate manner.

For example, the position and movement sensors may comprise contact sensors, each mounted on a carriage and suitable for being actuated by an abutment carried by the carriage situated upstream in the exit direction of the slats or by the carrier structure for the carriage of the last slat in the exit direction. These contact sensors serve to identify the positions of the slats, in particular when they are in the stowed position. The movement sensors likewise comprise sensors for measuring rotation of the movement motors, such as coders. These movement sensors serve to determine the linear movement of the carriages $\mathbf{10}_1$, $\mathbf{10}_2$ along their respective guide tracks 8.

The position and movement sensors also include sensors for measuring rotation of the adjustment motors 14 so as to determine the angles of inclination of the slats 3. The position and movement sensors also include sensors for detecting the directions in which the inclinations of the slats are being adjusted.

The installation 1 of the invention also includes a control device (not shown) that is connected to the position movement sensors, to the movement motors 12, and to the adjustment motors 14, enabling at least some of the slats 3 to be moved in translation and enabling the inclinations of said slats that have been moved in translation to be adjusted. Such a control device thus enables the movement motors 12 and of the adjustment motors 14 to be operated so as to enable one or more zones of the surface 2 to be covered or uncovered either on request or as a function of pre-stored programs. The control device preferably includes a control unit and a power supply that is remote from the installation and that is connected to electronic circuits 81 on board the carriages $\mathbf{10}_1$, $\mathbf{10}_2$. The control device preferably includes a remote control for remotely controlling the installation of the invention.

Naturally, the control device includes a calibration mode enabling the installation to position the slats 3 in a defined position in order to identify their positions. In general manner, before first use of the installation, the control system controls the motors 12, 14 in order to place the various slats 3 in the stowed position and in the erect inclination. The positions of the slats 3 in the stowed position are identified by the contact sensors.

Preferably, the control device has a plurality of pre-recorded modes of use, each corresponding to a corresponding type of slat positioning. Thus, provision may be made to pre-store a mode in which the surface 2 is covered in full or a mode in which it is covered in part. Likewise, provision may be made to pre-store the inclinations of the slats either in an erect position or in a closed position or in an intermediate position.

In order to cover the surface 2, the slats 3 exit their stowed position in succession after each slat has moved through a determined deployment pitch and until the slats occupy their desired exit position. Advantageously, the deployment pitch of the slats corresponds to the spacing between two consecutive slats that touch each other in the screen position, which may be horizontal or vertical.

Thus, the movement motors 12 of the first slat $\mathbf{3}_1$ are controlled to move the carriages $\mathbf{10}_1$ and $\mathbf{10}_2$ of the first slat 3 in translation in the direction F. It should be observed that the keeper system 70 of the first slat $\mathbf{3}_1$ is unlocked as soon as the first slat moves in translation so that its spring rod 73 pivots to escape from the catch 74 carried by the carriage of the following track. The movement in translation of this first slat $\mathbf{3}_1$ leads to each retractable coupling A that is fastened to the carriage(s) of the first slat being driven without causing the second slat to move in translation, which second slat remains in the stored position as a result of the keeper system 70 keeping said slat in position.

Figure 11:
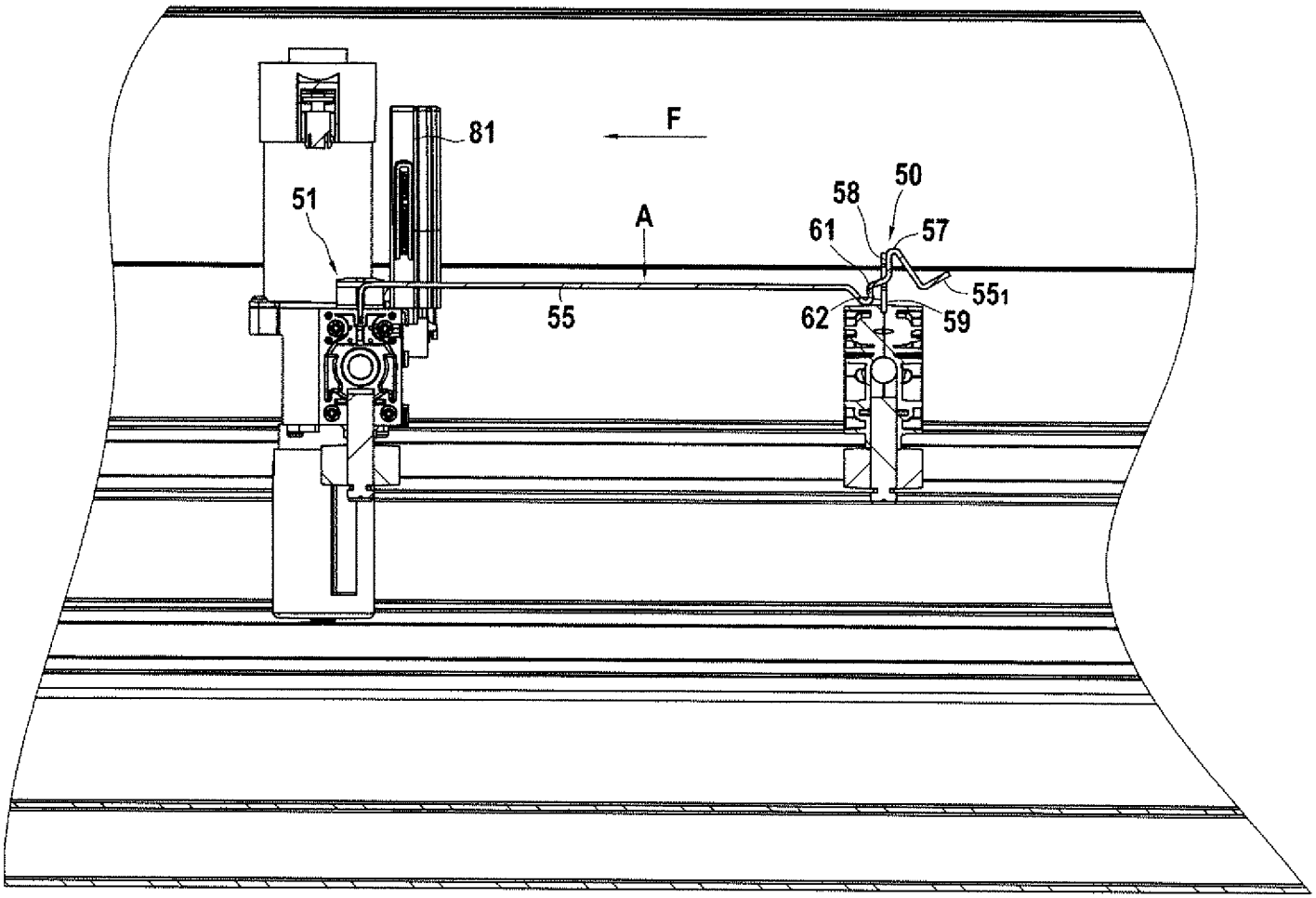
Figure 12:
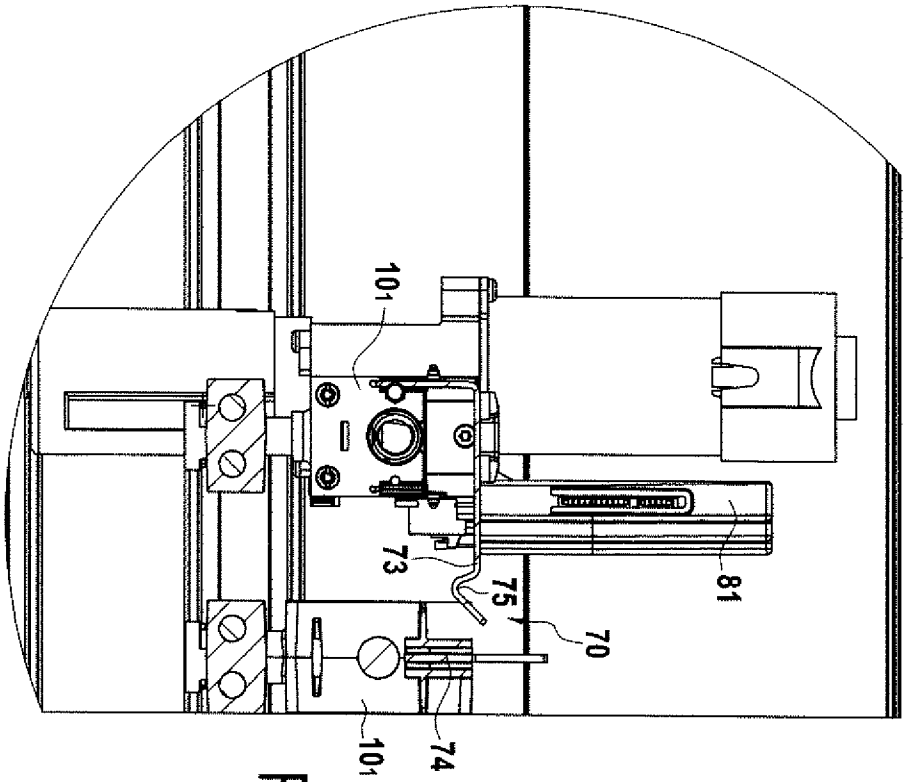
FIGS. 12 and 13 are respectively an elevation view and a plan view showing a system for blocking a slat in position, the system being in an inactive position.
Figure 13:
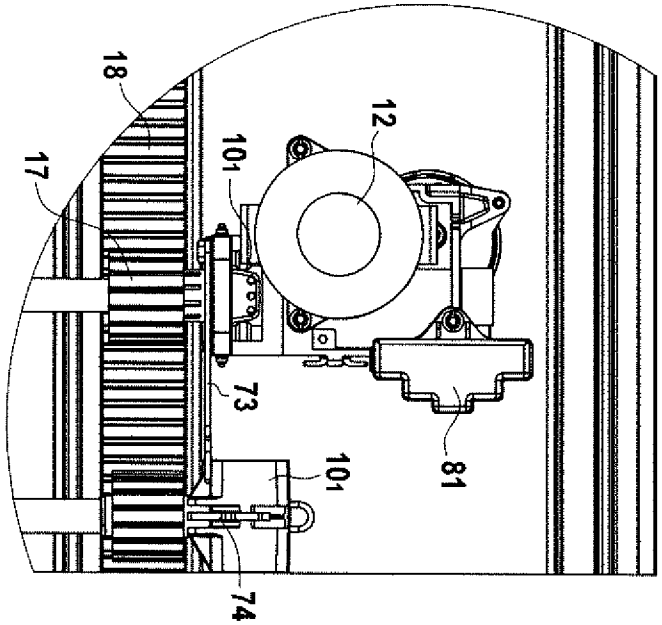
Figure 14:
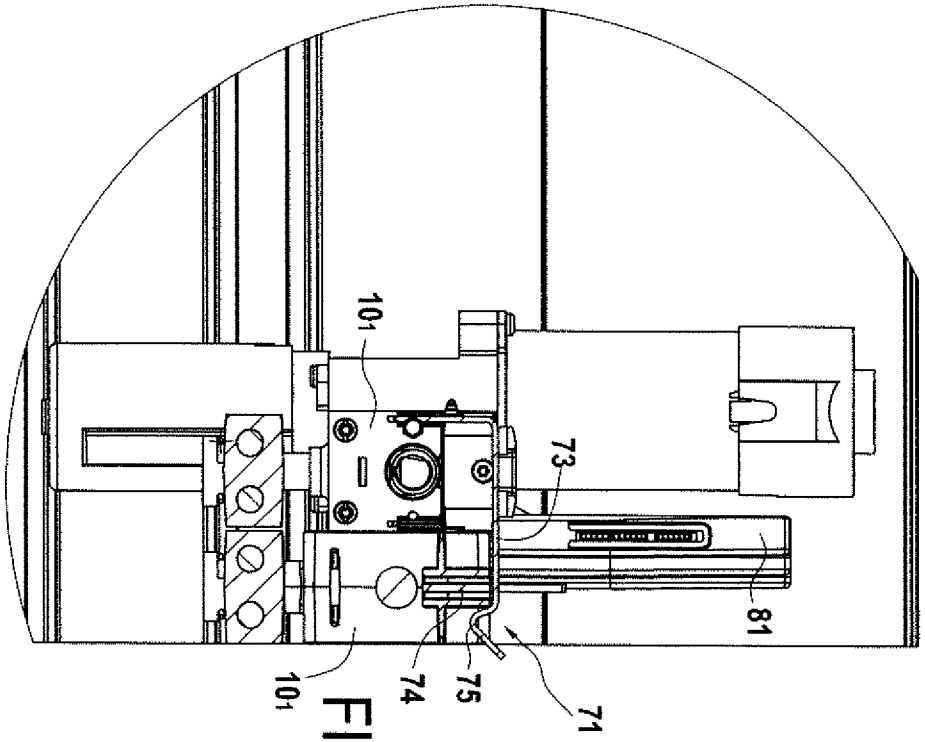
FIGS. 14 and 15 are respectively an elevation view and a plan view showing a system for blocking a slat in position, the system being in an active position.
Figure 15:
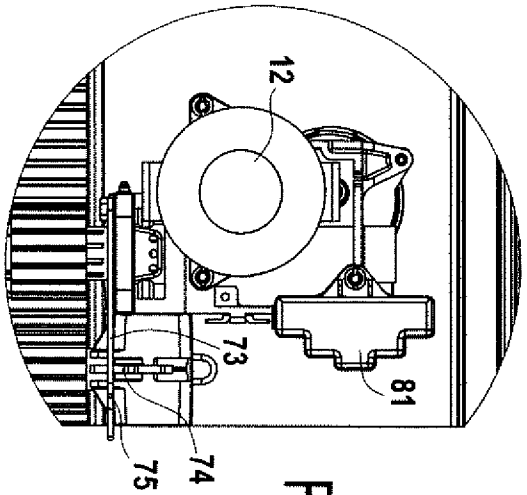

During this deployment stroke, the ramp 66 of the towbar co-operates with the plate 59 to enable the thrust surface 61 to pass through the through opening 60 and to enable the traction surface 57 to become positioned facing the first abutment 58 as soon as the ramp 66 ceases to co-operate with the plate. When the first slat $\mathbf{3}_1$ has been moved through a given deployment pitch, the traction surface 57 of each towbar 55 co-operates with the first abutment 58 carried by the carriage of the second slat, thereby enabling the second slat to be moved in translation (FIG. 11). As soon as the first slat $3_1$ has been moved through the deployment pitch, the movement motor 12 of the second slat is controlled so as to move the carriages $10_1$ and $10_2$ of the second slat in translation in the direction F. It should be observed that the keeper system 70 of the second slat is unlocked simultaneously, given the traction force exerted on the second slat.

The control device thus operates the movement motors 12 associated with the slats 3 in succession before they are deployed. The control device stops operation of the movement motors 12 once each slat 3 occupies its desired deployed position. Operation of the movement motors 12 is stopped either directly by the user as a function of the deployment selected for the slats, or else in compliance with a pre-stored program that makes provision for positioning the slats 3 in defined positions determined by the sensors for measuring rotation of the movement motors 12.

When the deployed slats 3 occupy a stationary position, the control device can operate the opening motors 14 to adjust the inclination of the slats 3.

It should be observed that the control device causes the adjustment motors 14 to operate only if the slats 3 are occupying a stationary position other than the stowed position. It should be recalled that the slats are erect in the stowed position.

In order to stow the slats 3, the control device operates the adjustment motors 14 of the deployed slats so as to position them in the erect position. When the deployed slats 3 occupy their erect positions, the control device causes the movement motors 12 of these slats to operate simultaneously so as to bring them successively into their stowed positions, as detected by the position sensors.

It should be observed that during the return of the slats 3 in the direction $F_1$, each retractable coupling A remains in the towing position with a thrust force being applied from each slat of lower number against the neighboring slat of higher number so long as the last deployed slat has not reached its stowed position. It should be observed that in the embodiment where the couplings are towbars, the thrust surface 61 of each towbar 55 co-operates with the second abutment 62 carried by the carriage of the slat of higher number (FIG. 10).

When the last-deployed slat (first slat that is stowed) reaches its stowed position, the movement motor 12 of that slat is stopped and the spring rod 73 carried by a carriage of said slat co-operates with the catch 74 placed on the carrier structure 5. Furthermore, each retractable coupling A fastened between the last slat and the slat of lower number retracts. Specifically, each towbar 55 carried by the last but one slat co-operates with the ramp 64 carried by the stowage edge 51 of the carrier structure 5, thereby raising the towbar so as to eliminate contact between the thrust surface 61 and the second abutment 62. Each towbar 55 passes through the through opening 60 so that the slat of lower number can move until it reaches its stowed position. When this slat reaches its stowed position, the movement motor 12 of that slat is stopped and the spring rod 73 carried by a carriage of said slat of lower number co-operates with the catch 74 placed on a carriage of the already-stowed slat. The following slats are stowed in succession one after another using the above-described process.

The control device can thus control the movement motors 12 and the adjustment motors 14 of the slats selectively in order to cover all or part of the surface 2 with the slats in the erect position, in the closed position, or in an intermediate position. It should be observed that the slats 3 are moved in translation only while they are in the erect position.

The invention is not limited to the examples described and shown since various modifications may be made thereto without going beyond the ambit of the invention.

The invention claimed is:

1. An apparatus for using slats (3) of adjustable inclination to cover and uncover a surface (2) defined by a carrier structure (5), the apparatus comprising:

a carrier structure (5);

a series of adjustable slats (3) comprising odd-numbered slats including at least one head slat and even-numbered slats interposed between the odd-numbered slats, each of the adjustable slats having longitudinal edges and end edges, the adjustable slats extending parallel to one another via the longitudinal edges and each of the adjustable slats being fitted at the end edges with respective pivot pins (4), the odd-number adjustable slats and even-numbered adjustable slats forming a set of numbered adjustable slats, numbering of the adjustable slats increasing from the at least one head slat;

each adjustable slat (3) is supported via the pivot pins (4) thereof by a set, the set comprising a first carriage ($10_1$) and a second carriage ($10_2$), each of the first and second carriages guided to move in translation along two guide tracks (8);

the two guide tracks (8) for guiding movement of the first and second carriages in translation, the two guide tracks being provided on the carrier structure (5) and being arranged in parallel with each other along two opposite sides of the surface;

an adjustment system (I) for adjusting an inclination of the adjustable slats (3) and adapted to cause at least some of the adjustable slats to pivot so that the longitudinal edges of the adjustable slats touch so as to close the surface or do not touch so as to open the surface;

a movement system (II) for moving the adjustable slats (3) between a stowed position in which the adjustable slats touch one another and a deployed position in which at least some of the adjustable slats, including the at least one head slat, are deployed in register with the surface;

position and movement sensors for detecting the stowed and deployed positions and the movements of the adjustable slats (3); and a control device connected to the position and movement sensors, to the movement system (II), and to the adjustment system (I), in order to move at least some of the adjustable slats in translation and to adjust an inclination of the adjustable slats that have been moved in translation; the apparatus being characterized in that: the movement system (II) comprises: for the at least one head slat, movement motors (12) on board the first and second carriages thereof;

for the even-numbered slats, firstly a retractable coupling (A) fastened between the first carriage of one of the even-numbered adjustable slats and the first carriage belonging to the at least one head slat or to a neighboring adjustable slat of lower number, and secondly a drive system (S) for driving the second carriage of the even-numbered adjustable slat in translation; and for each odd-numbered slat that is present, a retractable coupling (A) fastened between the second carriage ($10_2$) of the odd-numbered adjustable slat and the second carriage ($10_2$) belonging to a neighboring adjustable slat of lower number, and a drive system (S) for driving the first carriage of the odd-numbered adjustable slat in translation; and in that the movement motors (12) on board the first and second carriages are connected to transformation mechanisms for transforming rotary motion into movement of the adjustable slats in translation along a direction parallel to the two guide tracks.

2. The apparatus according to claim 1, wherein the drive system (S) for driving the first and second carriages in translation comprises either a movement motor (12) on board one of the first and second carriages or a retractable coupling (A) fastened respectively between one of the first and second carriages of one of the adjustable slats and the neighboring adjustable slat of lower number.

3. The apparatus according to claim 1, wherein the at least one head slat comprises a single head slat, the movement system (II) comprises the single head slat and even and odd numbered adjustable slats forming successive adjustable slat pairs, each successive adjustable slat pair having an adjustable slat in common, the adjustable slats being connected together by retractable couplings (A) mounted in alternation between the first carriages and the second carriages of the successive adjustable slat pairs.

4. The apparatus according to claim 1, wherein the at least one head slat comprises a plurality of head slats, each of the plurality of head slats driving at least one adjustable slat in order to form an adjustable slat group, the adjustable slat groups not being connected to one another.

5. The apparatus according to claim 1, wherein each retractable coupling (A) between the first carriages or the second carriages of an adjustable slat of given number and an adjustable slat of lower number comprises firstly a keeper system (70) for keeping the adjustable slat of given number in position so long as an adjustable slat of lower number has not been moved through a determined deployment stroke thereof, and secondly an unlocking system (71) for unlocking the keeper system (70) as soon as the adjustable slat of lower number has been moved through the deployment stroke thereof.

6. The apparatus according to claim 1, wherein each movement motor (12) drives a respective gearwheel (17) in rotation that co-operates with a rack (18) mounted on the carrier structure in a direction parallel to the two guide tracks.

7. The apparatus according to claim 1, wherein the position and movement sensors of the adjustable slats comprise contact sensors mounted on the first and second carriages of the two guide tracks in order to be actuated by one of the first or second carriages that is situated upstream in an adjustable slat exit direction or by the carrier structure for the first or second carriage of the last adjustable slat in the adjustable slat exit direction.

8. The apparatus according to claim 1, wherein the control device has a plurality of pre-stored modes of operation including a calibration mode and a plurality of utilization modes, each of the plurality of pre-stored modes corresponding to a respective type of positioning of the slats.

9. The apparatus according to claim 1, wherein each retractable coupling (A) between the first carriages or the second carriages of an adjustable slat having a number and an adjustable slat having a lower number comprises firstly a locking mechanism (50) for locking the retractable coupling (A) in a towing position when the adjustable slat of lower number has been moved through a deployment pitch, and secondly an unlocking mechanism (51) for unlocking the locking mechanism (50) in order to place the retractable coupling (A) in a retracted position and acting as soon as the adjustable slat of given number occupies a stowed position thereof.

10. The apparatus according to claim 9, wherein each retractable coupling (A) between one of the first and carriages of an adjustable slat of given number and an adjustable slat of a lower number comprises the locking mechanism (50) for locking the retractable coupling (A) in a towing position, a towbar (55) carried by the first or second carriage of the adjustable slat of lower number and arranged to present:

firstly a traction surface (57) that is to co-operate with a first abutment (58) carried by the first or second carriage of the adjustable slat of given number only when the adjustable slat of lower number has been moved through a determined deployment stroke thereof and during operation of deploying said adjustable slats, and secondly a thrust surface (61) for co-operating with a second abutment (62) carried by the first or second carriage of the adjustable slat of given number, so long as the adjustable slat of given number has not reached a stowed position thereof during operation of stowing the adjustable slats, the towbar (55) co-operating, when the adjustable slat of given number has reached a stowed position thereof, with the unlocking mechanism (51) between the thrust surface (61) and the second abutment (62) so that the adjustable slat of lower number can move until reaching a stowed position thereof.

11. The apparatus according to claim 9, wherein each retractable coupling (A) includes as a system (70) for keeping an adjustable slat in position, the system including a spring rod (73) carried by the adjustable slat and cooperating with a catch (74) placed upstream from the adjustable slat, the spring rod presenting a fold (75) that is suitable for being released from the catch under the action of a traction force exerted by an adjustable slat of lower number.

12. The apparatus according to claim 9, wherein each retractable coupling (A) between first or second carriages of an adjustable slat of given number and an adjustable slat of a lower number comprises two hinged links (76, 77) for co-operating with the locking mechanism (50) of the retractable coupling (A) to form a first linkage that is incompressible in the towing position, the two hinged links (76, 77) forming a flexible linkage under action of the unlocking mechanism for unlocking the locking mechanism in order to place the retractable coupling (A) in a retracted position.

13. The apparatus according to claim 1, wherein for each pair of first and second carriages fitted to an adjustable slat, the adjustment system (I) comprises at least one adjustment motor (14) on board at least one of first or second carriages and angularly connected with the pivot pin (4).

14. The apparatus according to claim 13, wherein for each adjustable slat, the movement motor (12) and the at least one adjustment motor (14) are mounted together on the first or second carriage, the first or second carriages fitted with the movement and the at least one adjustment motors being mounted in alternation from one adjustable slat to the next, along each of a side of the surface for covering or uncovering.

15. The apparatus according to claim 13, wherein each second carriage ($\mathbf{10}_2$) fitted with a movement motor (12) and with the at least one adjustment motor (14) comprises a main support body (15) for the movement motor and for the adjustment motor, the main body (15) being provided with a guide system (41) for guiding rotation of a tubular shaft (42) fitted with a gearwheel (17) and driven in rotation by the movement motor, the pivot pin (4) being mounted inside the tubular shaft (42) being turned by the adjustment motor (14) and being constrained to turn with one of the adjustable slats.

16. The apparatus according to claim 13, wherein the position and movement sensors of the adjustable slats (3) comprise sensors for measuring rotation of the movement motors and rotation of the at least one adjustment motor, together with sensors for detecting a direction of inclination of the adjustable slats.

17. The apparatus according to claim 13, wherein the control device controls operation of the movement motors (12) and of the at least one adjustment motor (14) in such a manner that prior to causing an adjustable slat to move, the control device causes the at least one adjustment motor of the adjustable slat to place the adjustable slat in a vertical position if the adjustable slat is not already in the vertical position.

18. The according to claim 13, wherein the control device controls operation of the at least one adjustment motor (14) only if the adjustable slat is occupying a stationary position that is not a stowed position for the adjustable slat.

19. The apparatus according to claim 1, wherein for a mode of utilization consisting in causing a determined number of adjustable slats to exit from a stowed position thereof, the control device causes the movement motors (12) of the adjustable slats that are to be deployed to operate so that each time a first adjustable slat advances through one deployment pitch, the adjustable slat situated upstream is caused to move, the movement motors (12) of the adjustable slats being operated until the adjustable slats occupy exit positions.

20. The apparatus according to claim 19, wherein the control device controls the movement motors (12) in such a manner that a movement pitch of the adjustable slats corresponds to the spacing between two consecutive adjustable slats that are touching in a screen position.

* * * * *